US006689948B2

(12) United States Patent
Räisänen

(10) Patent No.: US 6,689,948 B2
(45) **Date of Patent: *Feb. 10, 2004**

(54) TRANSDUCER AND METHOD FOR FORMING A TRANSDUCER

(75) Inventor: Heikki Eero Räisänen, Jyväskylä (FI)

(73) Assignee: B-Band Oy, Vaajakoski (FI)

( * ) Notice: Subject to any disclaimer, the term of this patent is extended or adjusted under 35 U.S.C. 154(b) by 341 days.

This patent is subject to a terminal disclaimer.

(21) Appl. No.: 09/851,493

(22) Filed: May 8, 2001

(65) Prior Publication Data

US 2002/0152879 A1 Oct. 24, 2002

Related U.S. Application Data

(63) Continuation-in-part of application No. 09/553,566, filed on Apr. 21, 2000, now Pat. No. 6,242,683, which is a continuation-in-part of application No. 09/155,828, filed on Oct. 6, 1998, now Pat. No. 6,078,006.

(30) Foreign Application Priority Data

Apr. 17, 1996 (FI) ..... 961688

(51) Int. Cl.[7] ..... G10H 3/10; G10H 3/14
(52) U.S. Cl. ..... 84/733; 84/723
(58) Field of Search ..... 84/723–726, 728, 84/730–731, 733, DIG. 24

(56) References Cited

U.S. PATENT DOCUMENTS

| | | | | |
|---|---|---|---|---|
| 4,382,328 A | | 5/1983 | Janszen | |
| 4,654,546 A | | 3/1987 | Hirjavainen | |
| 5,123,325 A | | 6/1992 | Turner | |
| 5,204,487 A | | 4/1993 | Turner | |
| 5,319,153 A | | 6/1994 | Fishman | |
| 5,670,733 A | | 9/1997 | Fishman | |
| 6,078,006 A | | 6/2000 | Räisänen | |
| 6,242,683 B1 | * | 6/2001 | Raisanen et al. | 84/733 |

FOREIGN PATENT DOCUMENTS

| | | |
|---|---|---|
| JP | 7-160265 | 3/1993 |
| WO | WO 96/06718 | 3/1996 |

* cited by examiner

*Primary Examiner*—Marlon T. Fletcher
(74) *Attorney, Agent, or Firm*—Katten Muchin Zavis Rosenman

(57) ABSTRACT

Transducer for converting mechanical stress into electric signals, which transducer is composed of at least one electromechanical sheet and is capable of converting mechanical stress into electric signals and in which transducer at least one of the electrodes required by the electromechanical sheet is disposed on the surface of one or more thin and flexible dielectric materials, said electrodes forming electrically conductive surfaces of the transducer for connecting the transducer to a signal processing device, and which transducer is constructed of a unitary, thin and flexible layered sheet structure and has the same width throughout its length.

38 Claims, 20 Drawing Sheets

TRANSDUCER AND METHOD FOR FORMING A TRANSDUCER

CROSS-REFERENCES TO RELATED APPLICATIONS

The present application is a continuation-in-part of U.S. application Ser. No. 09/553,566, filed Apr. 21, 2000 now U.S. Pat. No. 6,242,683, which is a continuation-in-part of U.S. application Ser. No. 09/155,828, filed Oct. 6, 1998 now U.S. Pat. No. 6,078,006.

FIELD OF THE INVENTION

The present invention relates to a transducer and, in particular, a flexible, unitary electret film transducer for converting mechanical stress, such as mechanical vibrations, into electric signals, and to a method for its fabrication. The transducer is especially applicable for use in musical instruments, such as stringed musical instruments (guitars etc.), accelerometers and alike.

PRIOR ART

Saddle transducers i.e. pickups for acoustic guitars, designed to transform string vibrations into electric signals, are mounted under the saddle of the guitar. They have a transducer part of a length corresponding to that of the saddle and typically containing different layers of electromechanical transducer elements, dielectric material and electrically conductive electrode layers, and a connection cable part in which the signals are taken to a preamplifier inside the guitar via a small hole (diameter typically 3 mm) bored in the guitar's resonance box under the saddle. Saddle transducers may typically have a one or more transducer element layers. Contact pickups are also commonly used for amplifying musical instruments sound. Typically they consist a piezo ceramic disk. Contact pickups pick up the sound from vibrating surface to which it is attached by means of glue or putty.

As electromechanical transducer elements, piezoelectric crystals or piezoelectric sheet (e.g. polyvinylidene fluoride PVDF) are prior art. In the commonest transducer structures, the connecting cable part is implemented using screened coaxial cable, which is connected to the electrode layers of the transducer part by soldering. Such a transducer is presented e.g. in U.S. Pat. No. 5,319,153. A drawback with this type of structures is the difficulty of fabrication of the transducer and relatively high manufacturing costs, because much of the work has to be done manually. Moreover, the connections to the preamplifier generally have to be made by soldering, because no connectors of sufficiently small size to go through the hole provided under the saddle are available for coaxial cables and because the connection between the transducer itself and the cable makes it impossible to mount the transducer from below. In addition, piezoelectric crystals and sheets are associated with a certain characteristic sound that is not quite in keeping with the guitar's own acoustic sound. Further, the prior art saddle transducers structures comprise many material types, which affects to the sound produced by the saddle transducer.

The electret field, or the permanent electric charge, is achieved by injecting charges into dielectric material.

A dielectric porous electret film and manufacturing process for same, applicable for use as electromechanical material for a stringed musical instrument transducer, is described in U.S. Pat. No. 4,654,546, said dielectric film comprising permanently charged, biaxially oriented, foamed, usually homogenous film layer containing flat lens-like, shredded or cavitated gas bubbles which can also be called as voids or cells. The term "dielectric cellular electret film" is used here to refer to generally porous type electromechanical films having a permanent electric charge injected into material.

WO-publication 96/06718 presents a procedure for pressure inflation of a pre-foamed plastic film, that makes it possible to manufacture strongly foamed film products, involving a high foaming degree and allowing the thickness of the product to be increased without increasing the amount of plastic material. The term "dielectric swelled cellular electret film" is used herein to refer to a foamed film-like plastic product as described in that WO-publication and having a permanent electric charge injected into material.

SUMMARY OF THE INVENTION

The object of the present invention is to eliminate the drawbacks of prior art and achieve an improved transducer of a completely new type, in which a dielectric swelled cellular electret film is used to transform the string vibrations into electric signals instead of piezoelectric films or crystals. Flat lens-like gas bubbles in the electret film effectively limit the mobility of electret charges in the dielectric material, because the gases have an electric resistance five decades better than the best solid insulating materials have. At the same time, compared to hard structure of piezoelectric materials, they act as an elastic soft layer during the conversion of for example string vibrations into electric signals allowing pressure variations caused by vibrations to cause microscopic changes in its thickness. The change in thickness causes change in capacitance and produces an electrical output voltage in proportion to the sound source.

A further object of the invention is to produce a new type of transducer which, due to its elastic cellular structure, is capable of converting mechanical stress, such as string vibrations, into electric signals which, when converted into sound, compared to prior art piezoelectric saddle transducers or contact pickups, better correspond to the instrument's own acoustic sound and allows playing at high volumes before feedback. Because of the elastic porous structure, the young's modulus of the material is significantly lower and thus the impedance matching with wood is better than with piezoelectric materials. This results in natural sound similar to instruments own acoustic sound without any harshness or "quacking" as typically with piezoelectric materials.

Still another object of the invention is to produce a transducer which is of a construction thin enough to permit installation without changing any parts of the instrument, e.g. making the saddle lower, and which, when installed, does not affect the instrument's own acoustic sound, and is as easy to install as possible without soldering.

Still another object of the invention is to produce a stringed musical instrument transducer capable of converting the vibration of each string separately into an electric signal.

A further object of the invention is to produce a transducer as simple as possible, having no separate transducer part and no separate conductor for connecting it to a signal processing device, but which has a unitary, flexible and laminated structure and in which the connections for connecting it to a preamplifier can be disposed sequentially or side by side and which in itself is able to produce a balanced signal (differential transducer) according to the attached claims.

A further object of the invention is to produce a new kind accelerometer type contact pickup.

This kind of transducers can be very economically fabricated for example by screen-printing the required electrodes with silver paste on sheets of dielectric film (e.g. polyester) and/or directly to electret film, placing several electrodes side by side on the same sheet. By laminating such sheets and dielectric cellular electret film, preferably swelled, on top of each other so that charged dielectric cellular electret film is only placed on a desired area at one end of the sheet while the other end is provided with a connector part with different electrode layers side by side, a laminate sheet is obtained from which the transducers can be cut out e.g. by punching. After that, it is only necessary to join a suitable connector to the electrodes at the connector end of the transducer by pressing mechanically.

With this method, it is possible to produce ultra thin and flexible transducers of desired length, design, shape and width, in which the electrodes in the transducer part are continuous extending from the transducer part to the preamplifier and which are unitary, flexible and thin laminate in construction. Fabrication is faster and more economic than with conventional methods.

The structure of the invention thus allows the application of an effective and economic production technique, not only for under saddle transducers, but also for contact transducers.

In one embodiment of the invention, no dielectric firm plastic layer, where the young's modulus value typically is significantly higher than with cellular electret film, to carry the conductive electrodes, would be needed in the transducer structure adjacent to instrument saddle. Thus the transducer becomes thinner and the acoustic properties become excellent because the firm plastic layers are not absorbing and dampening the vibration energy. Further, because of saved thickness exclusive firm plastic films, the amount of transducer elements can be increased, without adding too much thickness, and thus the output voltage and therefore the signal-to-noise ratio are further improved. Further, due possible increase in thickness of elastic soft dielectric cellular layers the structure becomes softer which improves the string-to-string balance. Even further, in this embodiment the electrodes become more durable than screen-printed electrodes and the connectors in the preamplifier end can be easily connected to the transducer so that the there is no plastic layers in between and thus the electrical properties of connections become excellent and also more durable. Further, it is possible to simultaneously arrange the screening for the connection end and even soldering directly to the electrodes.

The structure of the invention thus allows the application of an effective and economic production technique with significantly improved sound and string-to-string balance properties.

BRIEF DESCRIPTION OF THE DRAWINGS

In the following, the invention is described in more detail by the aid of examples by referring to the attached drawings, in which.

DETAILED DESCRIPTION

Figure 1:
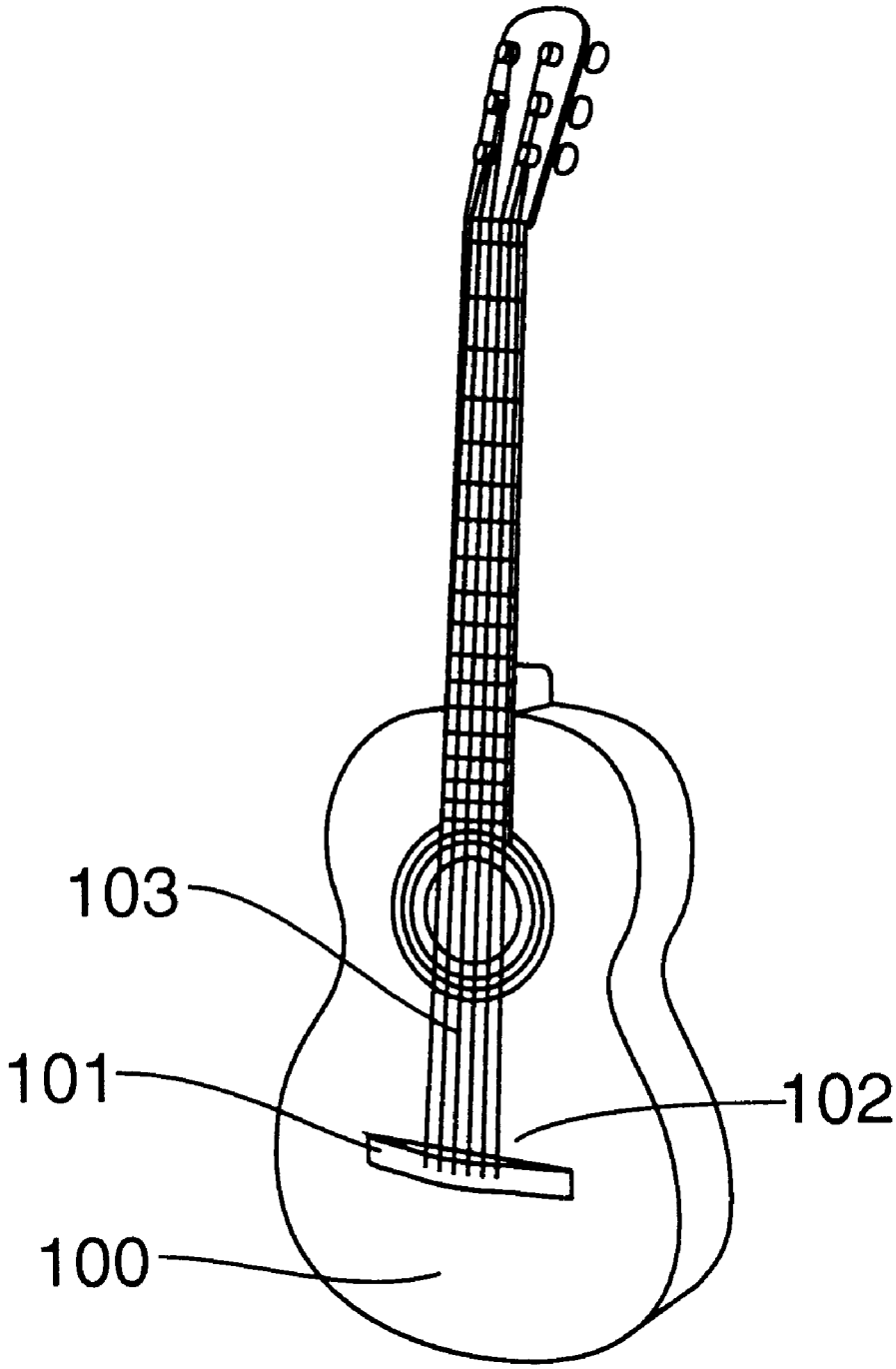
FIG. 1 is a perspective view of a guitar, with a transducer as provided by the invention mounted on it.
Figure 2A:
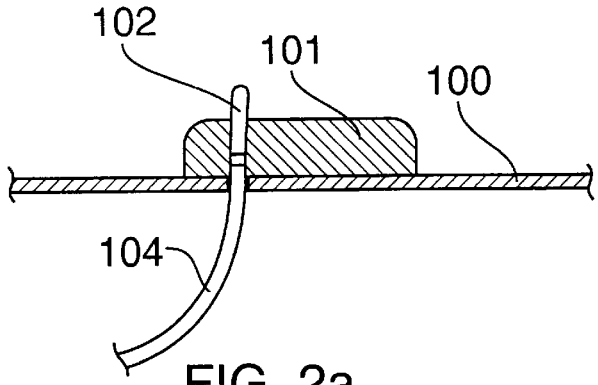
FIGS. 2*a*–2*c* present a cross-sectional view, top view and a longitudinal section of the saddle of a guitar with a transducer as provided by the invention mounted in conjunction with it.
Figure 2B:
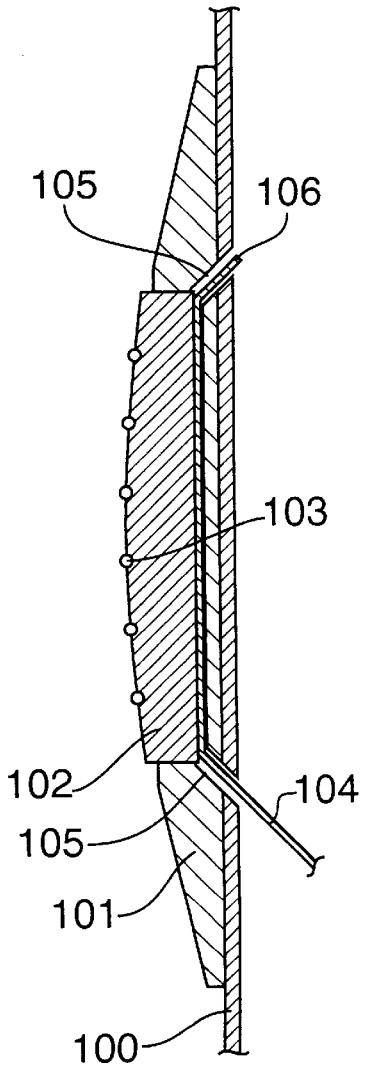
Figure 2C:
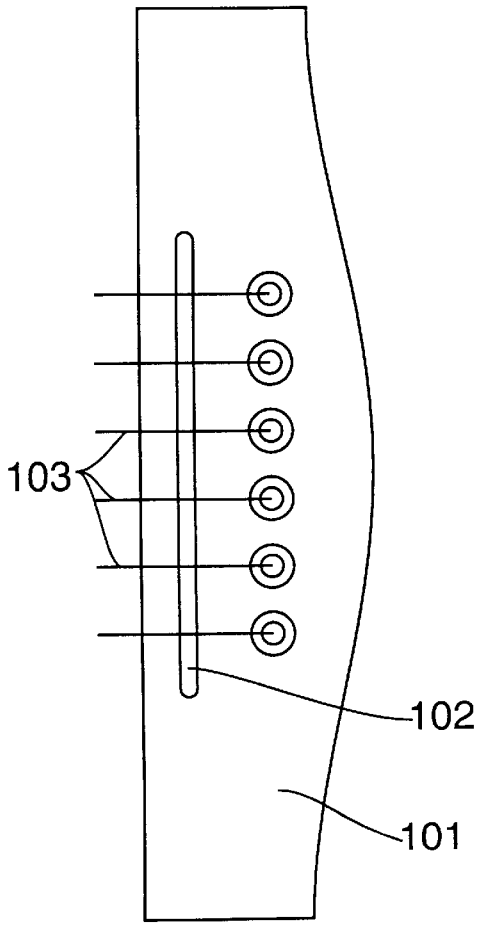

In FIGS. 1, 2*a*, 2*b*, 2*c*, the cover 100 of the resonance box of an acoustic guitar is presented. Fitted on the resonance box is a transverse bridge for the six strings 103 of the guitar, consisting of a bridge body 101 placed against the resonance box 100 and a saddle 102, whose upper edge is provided with notches for the strings 103.

Fitted under the saddle 102 is a transducer 104 as provided by the invention for transforming the vibrations of the strings 103 into electric signals.

Figure 3A:
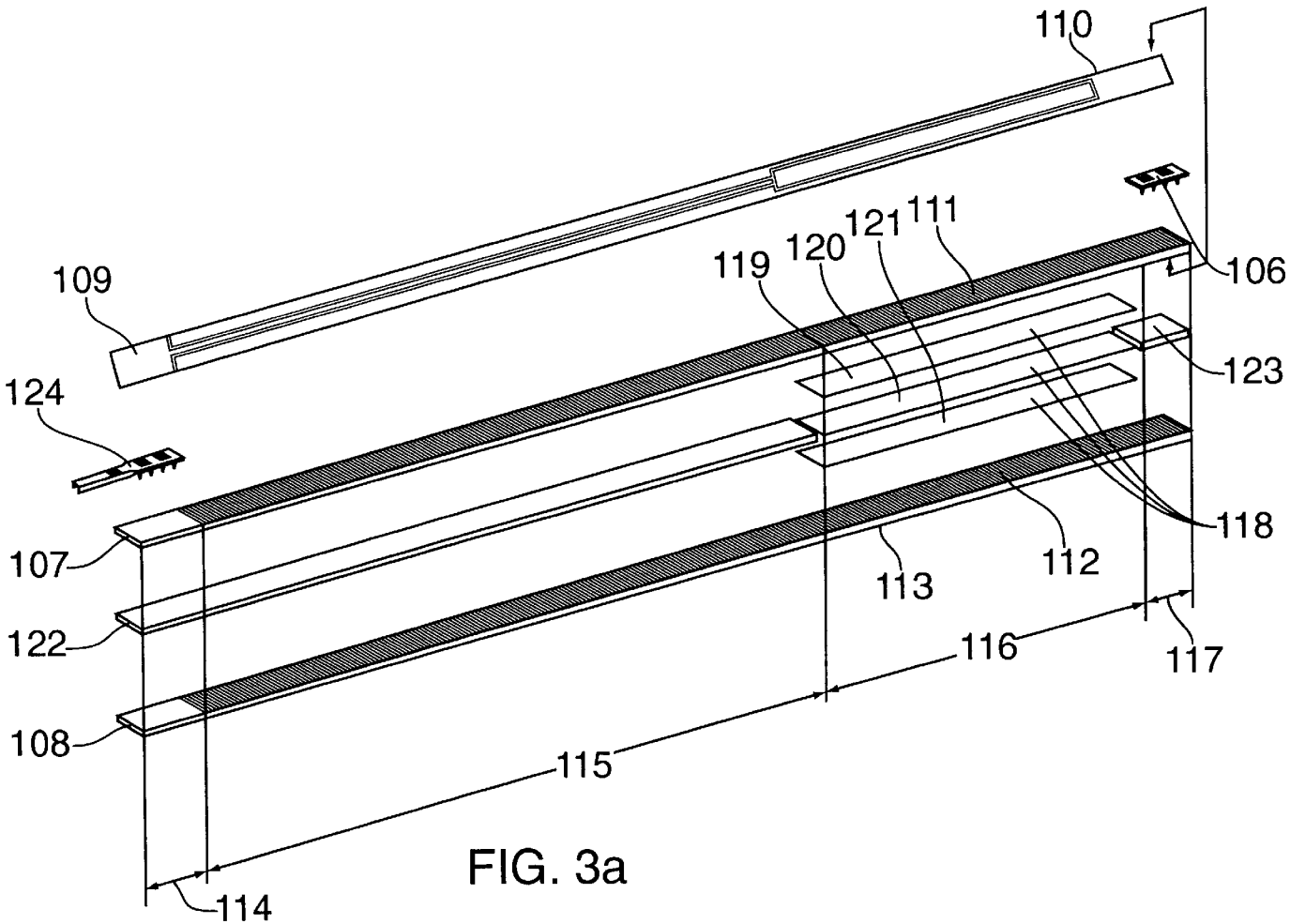
FIGS. 3*a*–3*d* present exploded perspective views illustrating the different components that comprise the transducer of the four different embodiments of the invention.

In the embodiment of FIG. 3*a* the transducer of the invention is composed of sheets 107 and 108 of dielectric film, which may be made e.g. of 0,1 mm thick polyester. On the underside of sheet 107, a signal electrode 109 is screen-printed by using e.g. silver or graphite. Printed around the signal electrode 109 is a ground electrode 110, which reduces electromagnetic interference noise in the signal. It is noted, however, that this ground electrode 110 is not essential to the structure. Screen-printed on the top surface of film sheet 107 is a ground electrode 111, which may also consist of aluminum foil or other electrically conductive foil suited for the purpose. Screen-printed on the top surface of sheet 108 is a ground electrode 112 and on the bottom surface also a ground electrode 113. It should be noted that this ground electrode 113 is not essential for the structure in this and other embodiments of the invention, where the transducer is not a differential transducer. Sheet 108 may also consist of e.g. thin aluminum or brass foil or other electrically conductive foil suited for the purpose. It is noted that the ground electrodes 110, 111, 112, 113 are shorter at the end 114 pointing towards the preamplifier than the signal electrode 109, whereas at the other end 117 the ground electrodes are somewhat longer than the signal electrode. Instead of being screen-printed, the electrodes may also be for example evaporated e.g. from aluminum onto dielectric films using a mask or etched from a metal/dielectric laminate such as copper/polyamide (for example Kapton®) laminate.

Figure 12:
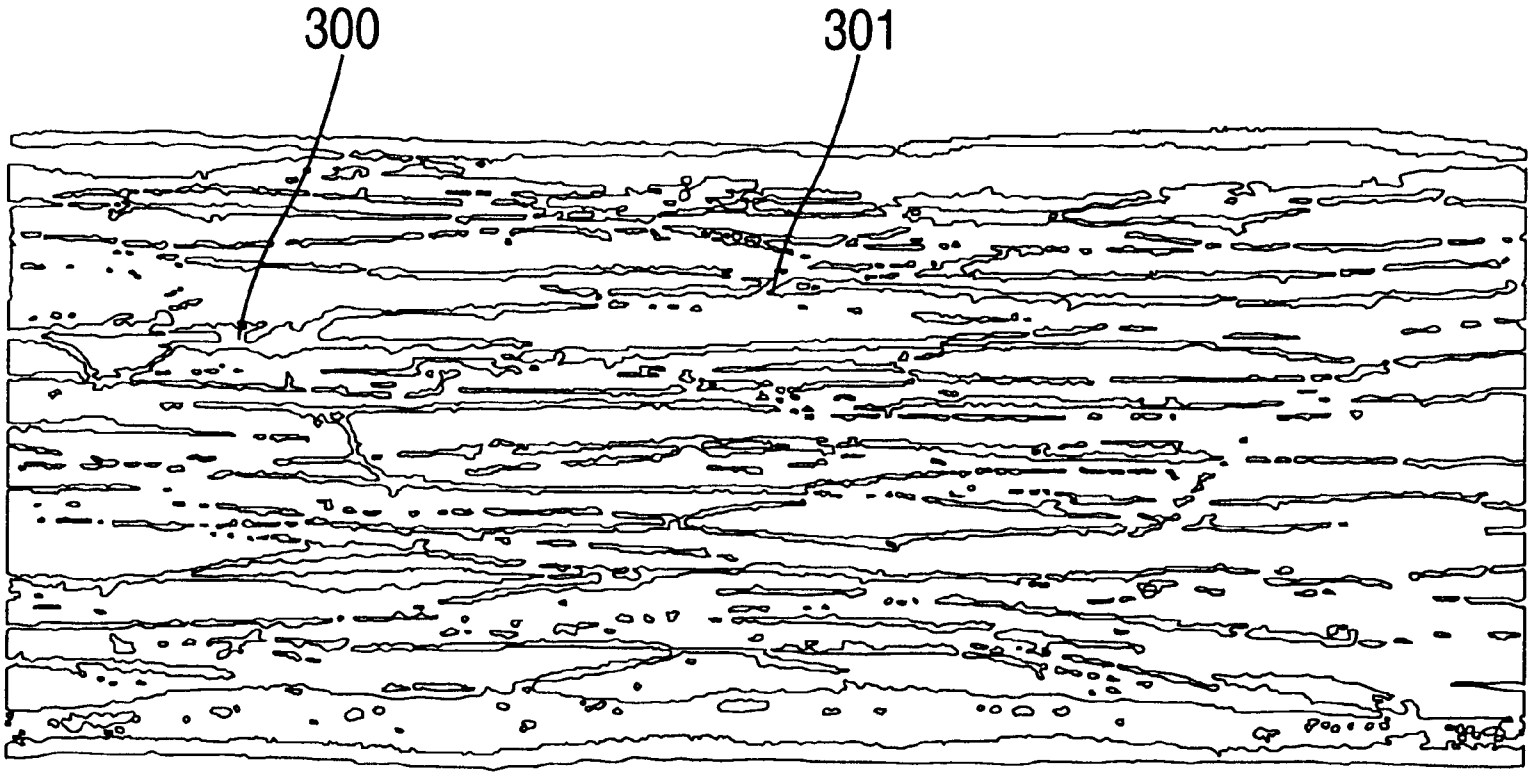
FIG. 12 presents a microscope picture of dielectric cellular electret film.

Between the sheets 107, 108 there is an transducer element 118. This element 118 is composed of three, preferably swelled, dielectric cellular electret films 119, 120, 121 having flat gas bubbles 301 inside the film material 300 (FIG. 12). Injected onto the underside of the topmost film 119 is a negative electric charge. Injected onto the top side of the intermediate film 120 is also a negative electric charge, while a positive electric charge is injected onto its underside. Injected onto the top side of the bottommost film 121 is a positive electric charge. After being charged, the films have been glued together. The bottommost films 121 bottom side may also be provided with a metallic electrically conductive surface, e.g. evaporated aluminum, which is to be noted is not necessary. This electrically conductive surface is possible to have also on topside as well as on one or both sides of films 119 (on topside when ground electrode 110 is not printed) and 120 but it is not recommended. With the charging procedure described, a maximal electric charge density is achieved. From the point of view of operation, it is sufficient to have only the surfaces of the intermediate film 120 charged. Such an element responds only to the pressure generated by the vibration of the strings, not to bending at all. The transducer element 118 may also consist of two dielectric cellular electret films, in which element 118 unlike charges of the films 119, 121 are placed opposite to each other. Such a structure mainly responds to pressure only and very slightly to bending and is thus applicable for converting the vibrations of the strings 103 into electric signals. By placing the films with like charges opposite to each other, an element mainly responsive to bending is achieved. For operation, it is sufficient that element 118 be composed of only one dielectric cellular electret film, preferably swelled.

Between sheets 107 and 108 there is also a dielectric film 122, which may be made e.g. of polyester, preferably of the same thickness as the film element 118. This insulation prevents a short circuit between the signal electrode 109 and the ground electrode 112. Instead of using a dielectric film 122, it is possible to provide the bottom surface of film 107 at the area 115 or the top surface of film 108 at the area 115 with dielectric insulation screen-printed over the electrode (s) on the surface to prevent short circuit. Between the film sheets 107, 108 there is also a dielectric film 123 on the other side of the element 118 at the area 117, preferably of the same thickness as film 122. Another possibility is to extend the element 118 consisting of dielectric cellular electret films to the end of area 117, in which case film 123 is not needed. Similarly, it is possible to extend the element 118 to the end of area 114 as well, in which case film 122 is not needed. At one end 117 of the transducer is a metallic connector 106 mechanically pressed through sheets 107, 123, 108, shorting the ground electrodes 111, 110, 112, 113. At the other end 114 is a metallic connector 124 mechanically pressed through sheets 107, 122, 108 to connect the signal electrode 109 to a signal processing device. The ground electrodes, which are all thus disposed on the outer surfaces of film sheets 107, 108, are grounded e.g. by pressing them between the halves of the casing of the signal processing device. It is recommendable to use a soft, electrically conductive material in this area between the halves of the casing. The grounding can also be implemented by pressing one of the ground electrodes 111, 113 against the circuit board of the signal processing device at a point reserved for it, at which point it is also recommendable to use electrically conductive rubber as mentioned above. Reference is now made to the FIGS. 4*a*–4*b*. Disposing the signal electrode and the ground electrodes in this way in sequence at the end of the transducer and grounding the transducer in the ways described above eliminates tension and also provides a transducer structure narrow enough to allow the transducers electrodes screen-printed closely side by side on the dielectric film sheets 125, 126, e.g. polyester of thickness 0,1 mm, maximizes the amount of the transducers from material and work used. In addition (referring to FIGS. 2*a*, 2*b*, 2*c*), such a narrow transducer having the same width throughout its length is very easy to install, because the connector of an individual electrode is so narrow that, in all guitars commonly used, in which the saddle width is on the order of 3 mm, it can go from above through the two holes 105 made on the sides of the bridge body 101 under the saddle 102 through the resonance box cover 100 to the inside of the guitar to connect the transducer to a signal processing device.

Figure 3B:
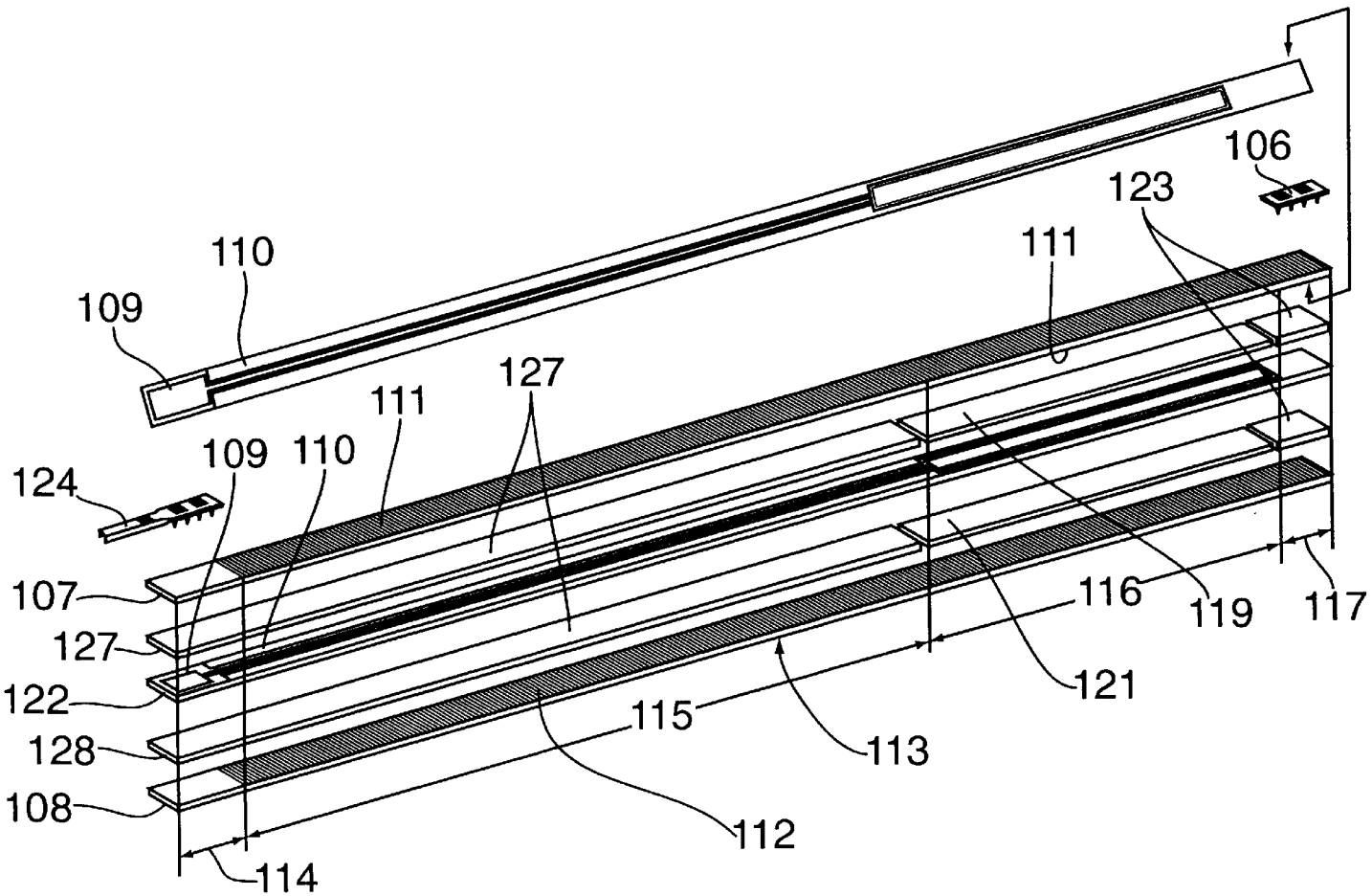

In the embodiment of FIG. 3*b* a transducer of the invention is fabricated in such manner that film 122 is continuous extending through areas 114, 115, 116, 117. Screen-printed on both the top side and on the bottom side of the film 122 is a signal electrode 109 and around it ground electrode 110, which ground electrode is again not essential to the structure. Screen-printed on both the top and bottom side of sheet 107 is an ground electrode 111. Screen-printed on top side of sheet 108 is ground electrode 112 and on the underside another ground electrode 113. Ground electrodes 111, 112, 113, do not extend to area 114. All ground electrodes are connected together by means of a connector 106. Disposed in area 116 above and below sheet 122 are preferably swelled dielectric cellular electret films 119, 121. Positive charges are injected onto the underside of sheet 119 and onto the top side of sheet 121. Negative charges may be injected onto the top side of sheet 119 and onto the underside of sheet 121 but it is not essential. By pressing a connector 124 on area 114, the signal electrodes 109 are connected together. At the area 115 between the sheets 107–122 and 122–108 is a dielectrict film 127 to prevent short circuit between signal and ground electrodes. In this embodiment of the invention the dielectrict cellular electret films are connected in parallel.

Figure 3C:
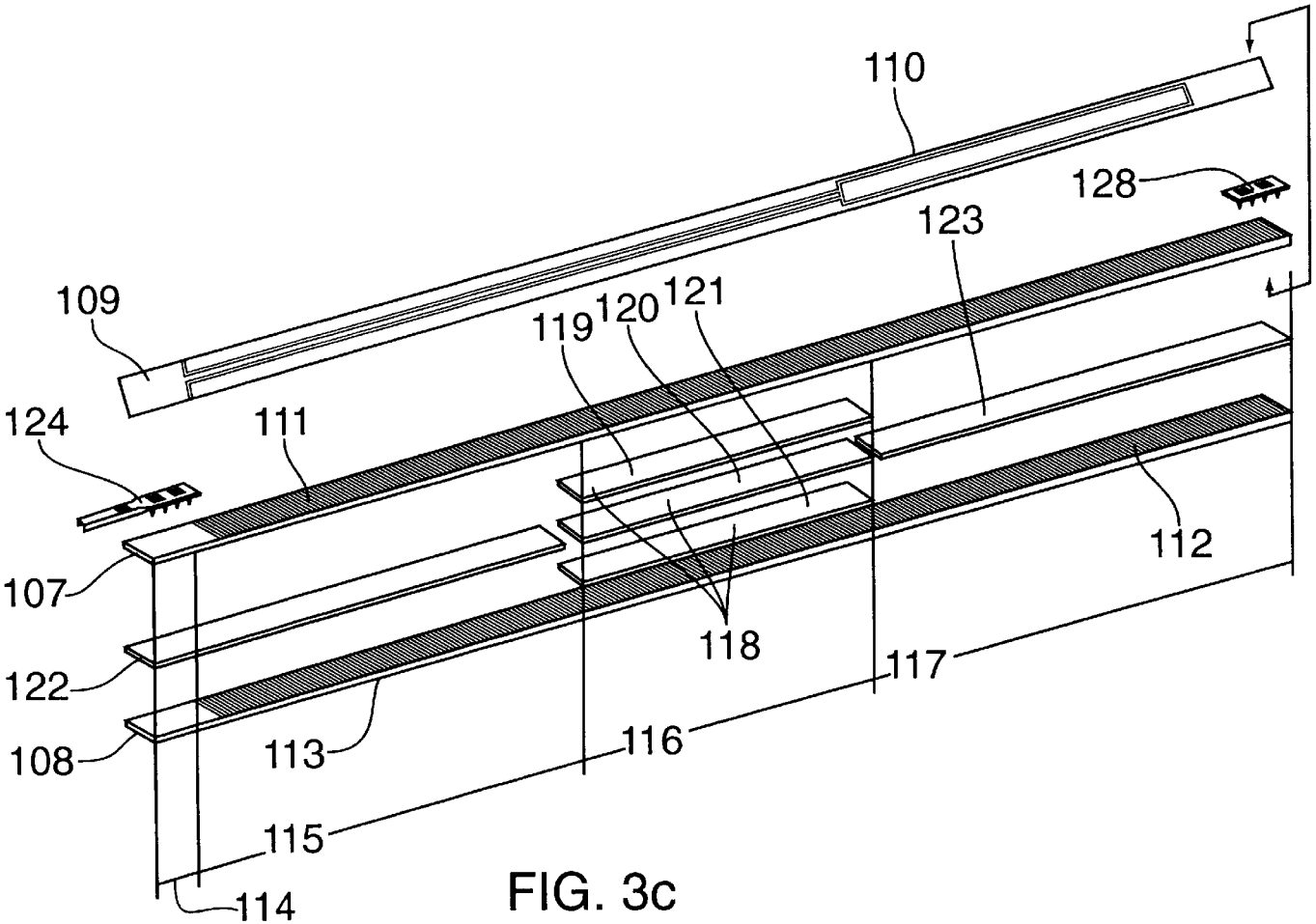

Reference is now made to FIG. 3*c*. By making the length of area 115 so long that connector 128 reaches the signal processing device too, a transducer is obtained whose ground electrodes 111, 110, 112, 113 can be connected to the circuit board of a signal processing device by means of a connector 128. Further, by using an arrangement where no ground electrode 110 is printed and on the top side of the sheet 108 to the areas 116, 117 is printed a signal electrode and by grounding both ground electrodes 111, 113 to the case of the signal processing device in the manner explained above, none of said ground electrodes 111, 113 extending to the connectors 124, 128, a differential transducer is obtained.

Figures 3D, 3E:
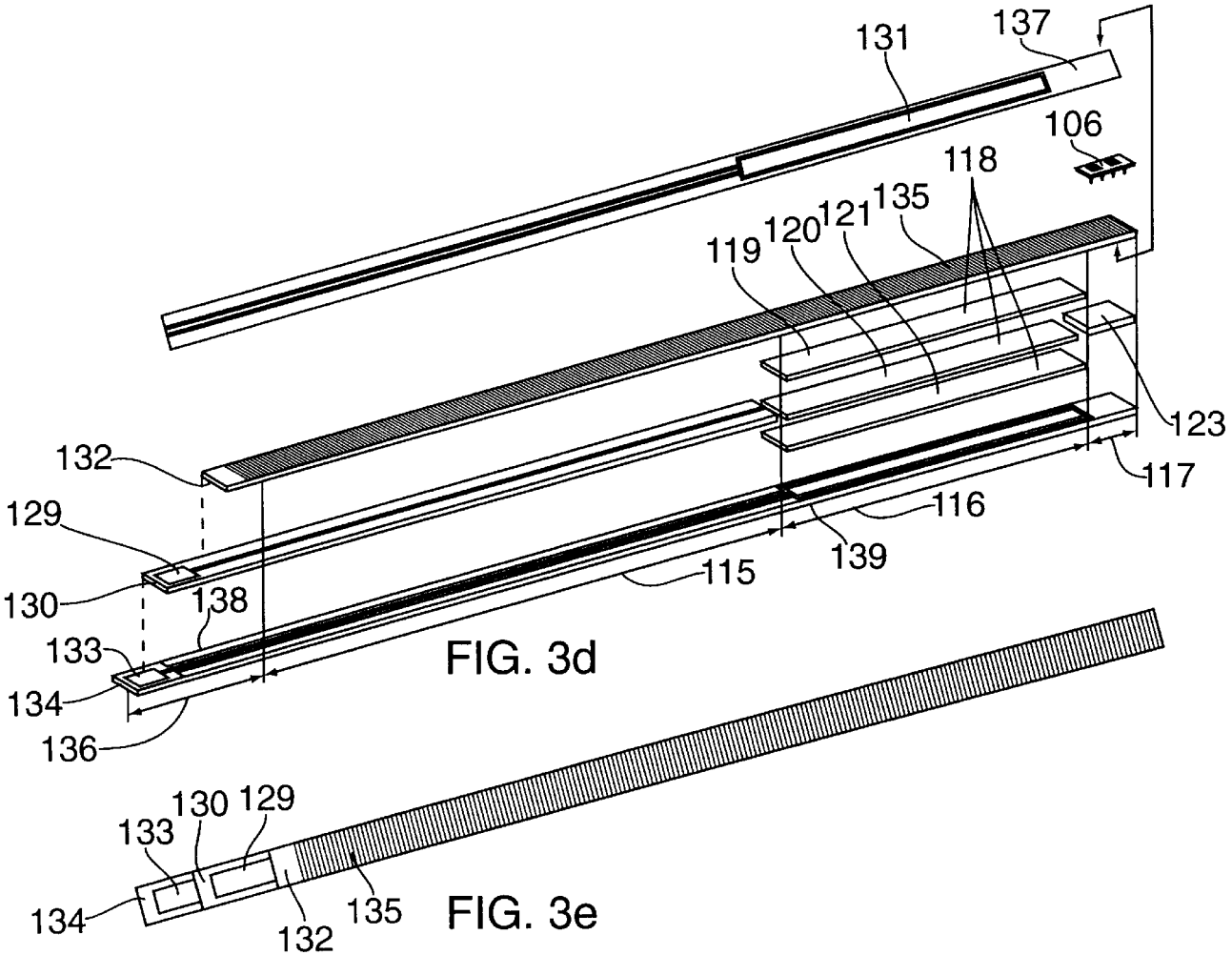
FIG. 3*e* presents top view of the embodiment of the invention presented in FIG. 3*d,*

In the embodiment of FIG. 3*e* a differential transducer of the invention is implemented by screen-printing signal electrode 129 on the top side of sheet 130 and connecting this signal electrode 129 to the signal electrode 131 using electrically conductive glue between sheets 130 and 132. This signal electrode 129 is made somewhat shorter than the sheet 130 itself. The signal electrode 133 screen-printed on the top side of sheet 134, which is electrically connected to the underside of the bottommost sheet 121 of the element 118, extends to the end of the sheet 134. The ground electrode 135 printed on the top side of sheet 132 is somewhat shorter than the sheet 132. At the transducer end 136, the film sheet lengths are such that sheet 132 is the shortest one of the sheets. Sheet 130 is somewhat longer and sheet 134 is the longest one. At the other end 117 of the transducer is a connector 106 which connects ground electrodes 135, 137, 138, 139 together. It is to be noted again that ground electrodes 138, 139 are not essential to the structure. In this way, an arrangement is achieved in which all signal and ground electrodes of the differential transducer needed to connect to a signal processing device are located sequentially at one end 136 of the transducer and on the same side of it (ref. FIG. 3*e*), enabling it to be connected to the circuit board of a signal processing device by pressing it onto the circuit board at a position provided with corresponding electrodes in sequence. If desired, grounding can also be effected via a connection between the halves of the casing as described above. By replacing the signal electrode 133 with an electrode which is printed in the shape of an ground electrode and has a length such that it is shorter at the transducer end 136 than sheet 130 and extends correspondingly to the other end 117 of the transducer, a non-differential transducer is obtained in which the electrodes for connecting the transducer to a signal processing device are on the same side in sequence at one end of the transducer.

Figure 5A:
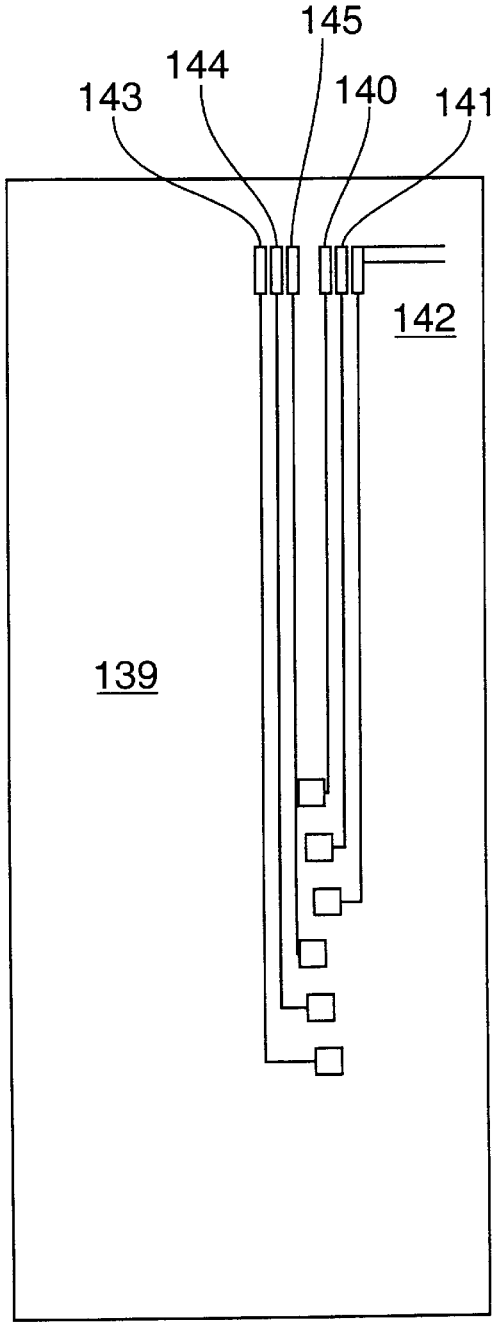
FIGS. 5*a*–5*d* present signal electrodes and ground electrodes printed on a sheet of dielectric film of two different embodiments of the invention, the two transducers having different electrodes at the connector end arranged side by side.
Figure 5B:
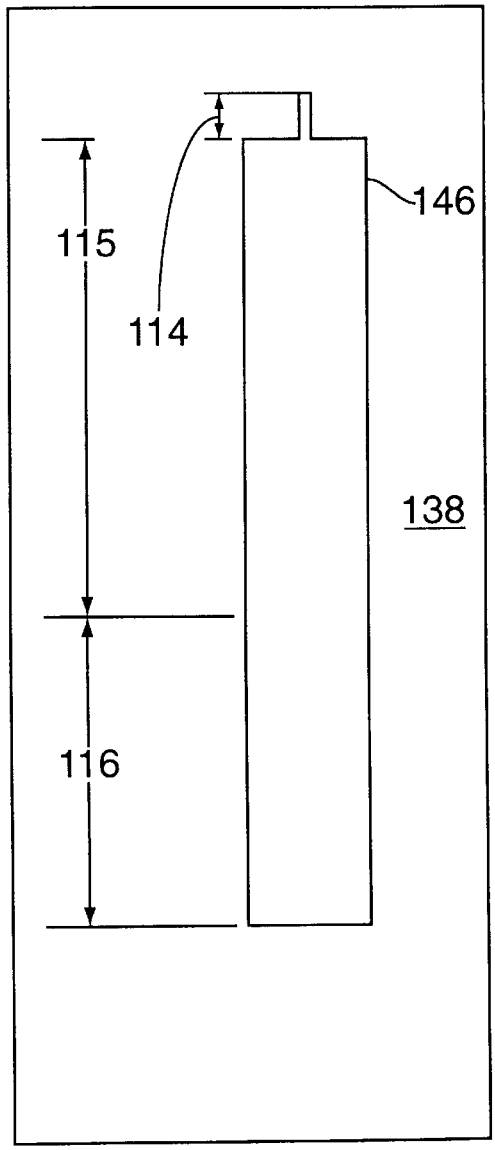
Figure 5C:
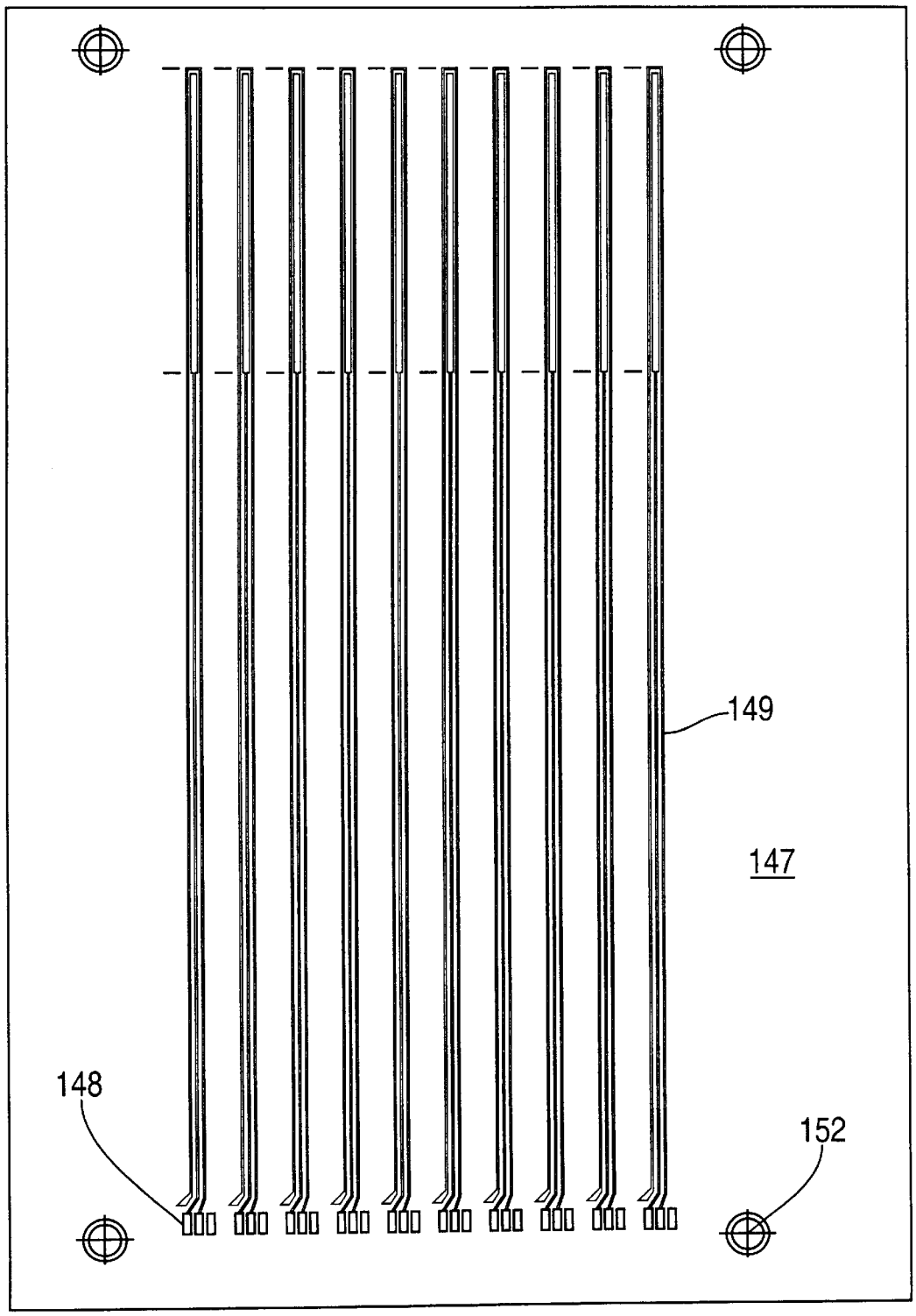
Figure 5D:
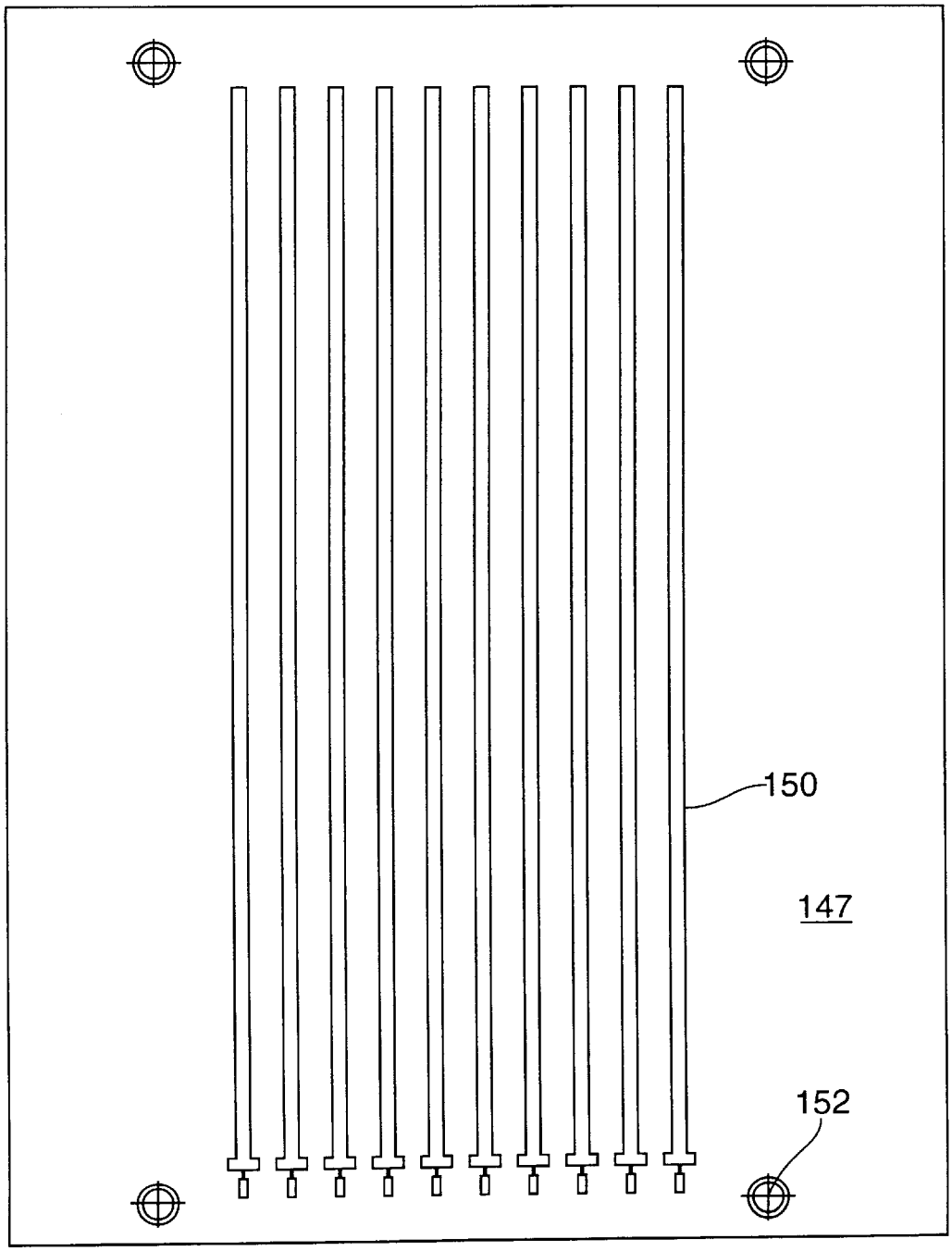
Figure 7:
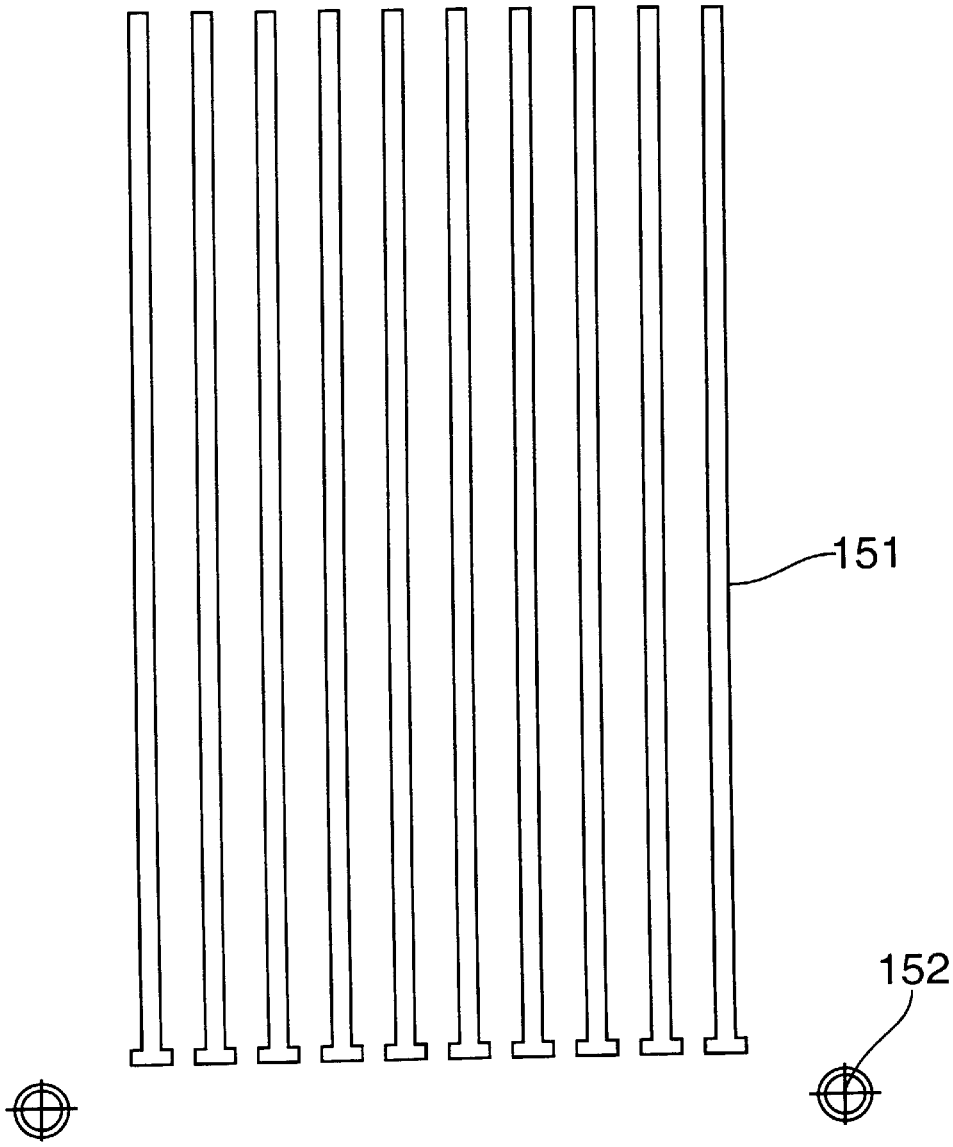
FIG. 7 presents pattern for screen-printing the insulation over the signal and ground electrodes, of the transducer of the embodiment in FIG. 5*c,*

Reference is now made to FIGS. 5*a*–5*d*. If desired, the signal and ground electrodes can also be printed so that they are placed side by side at the transducer end 114 as illustrated by FIGS. 5*a*–5*c*. In FIG. 5*a* there is signal electrodes screen-printed on a dielectric sheet 139 of an embodiment of the invention in which there is a separate signal electrode 140, 141, 142, 143, 144, 145 for each string of the guitar, in this case an electric guitar. The vibration of each string of the instrument is transformed into electric signal by the means of having a separate saddle-like piece under each string against disposed signal electrode of the transducer, the charge-signal generated to each electrode being processed separately in the signal processing device. This type of hex-microphone is needed e.g. for making a stereo image or in midi equipment, where the electronics converts the tone pitch into a voltage value controlling a synthesizer. In this embodiment too, the dielectric cellular electret film is placed on the area 116, an insulation is provided in the area 115 and metallic connectors 124 are mechanically pressed through the electrodes in the transducers end 114. In FIG. 5*b* there is the ground electrode 146 screen-printed on a dielectric sheet 138, e.g. polyester of the embodiment described above. In FIGS. 5*c*, 5*d* the pattern for printing the signal and ground electrodes of another embodiment of the invention where the transducer, in this case a differential transducer is obtained having the electrodes side by side at the connector end 114. In that embodiment the pattern shown in FIG. 5*c* shows signal electrodes 148 and around them ground electrodes 149. This pattern is screen-printed say on top side of the dielectric sheet 147 and on bottom side is screen-printed the ground electrodes, as illustrated in FIG. 5*d*. The pattern for screen-printing the dielectric insulation 151 over the electrodes shown in FIG. 5*c* is showed in FIG. 7.

Figure 4A:
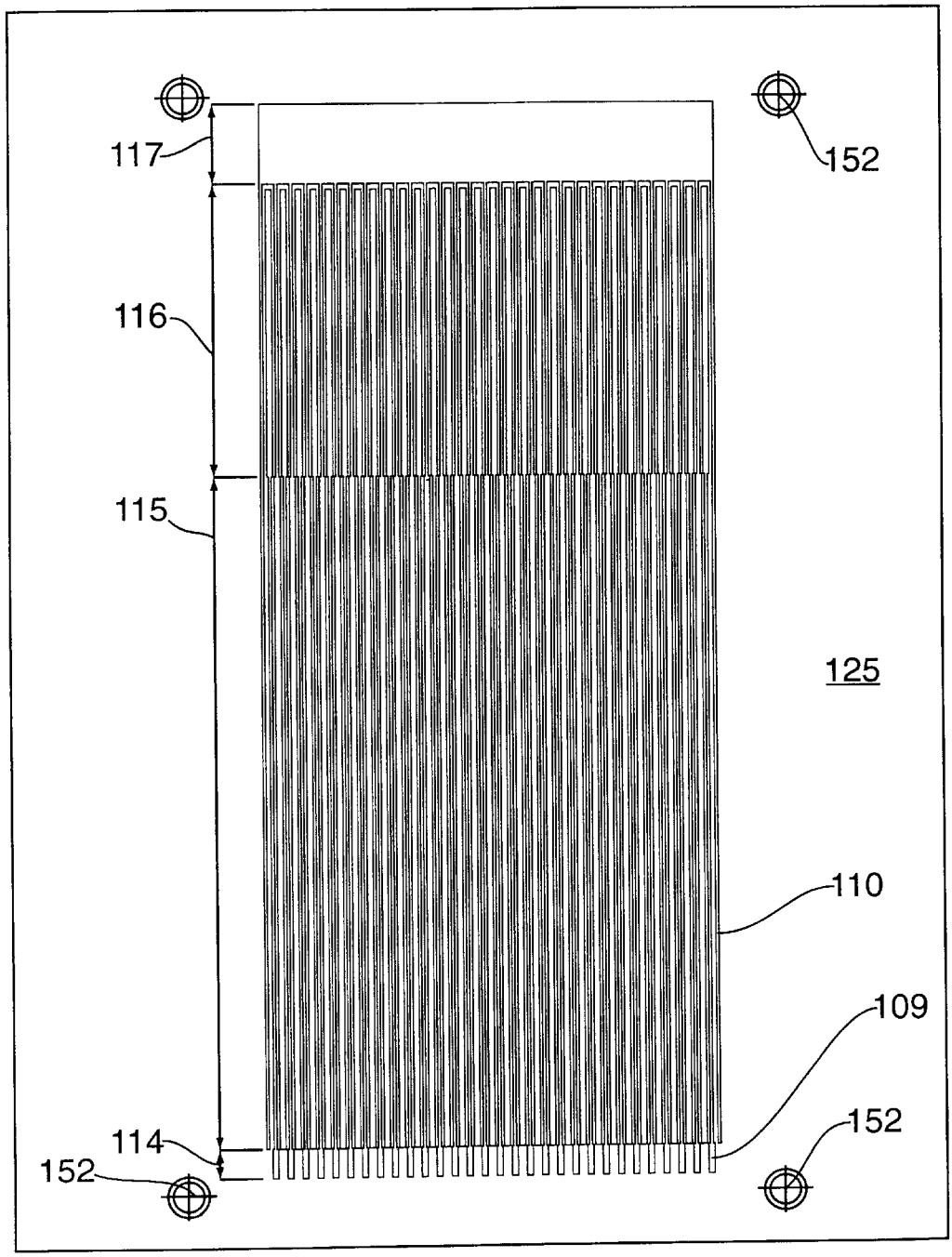
FIG. 4*a* present the signal electrodes.
Figure 4B:
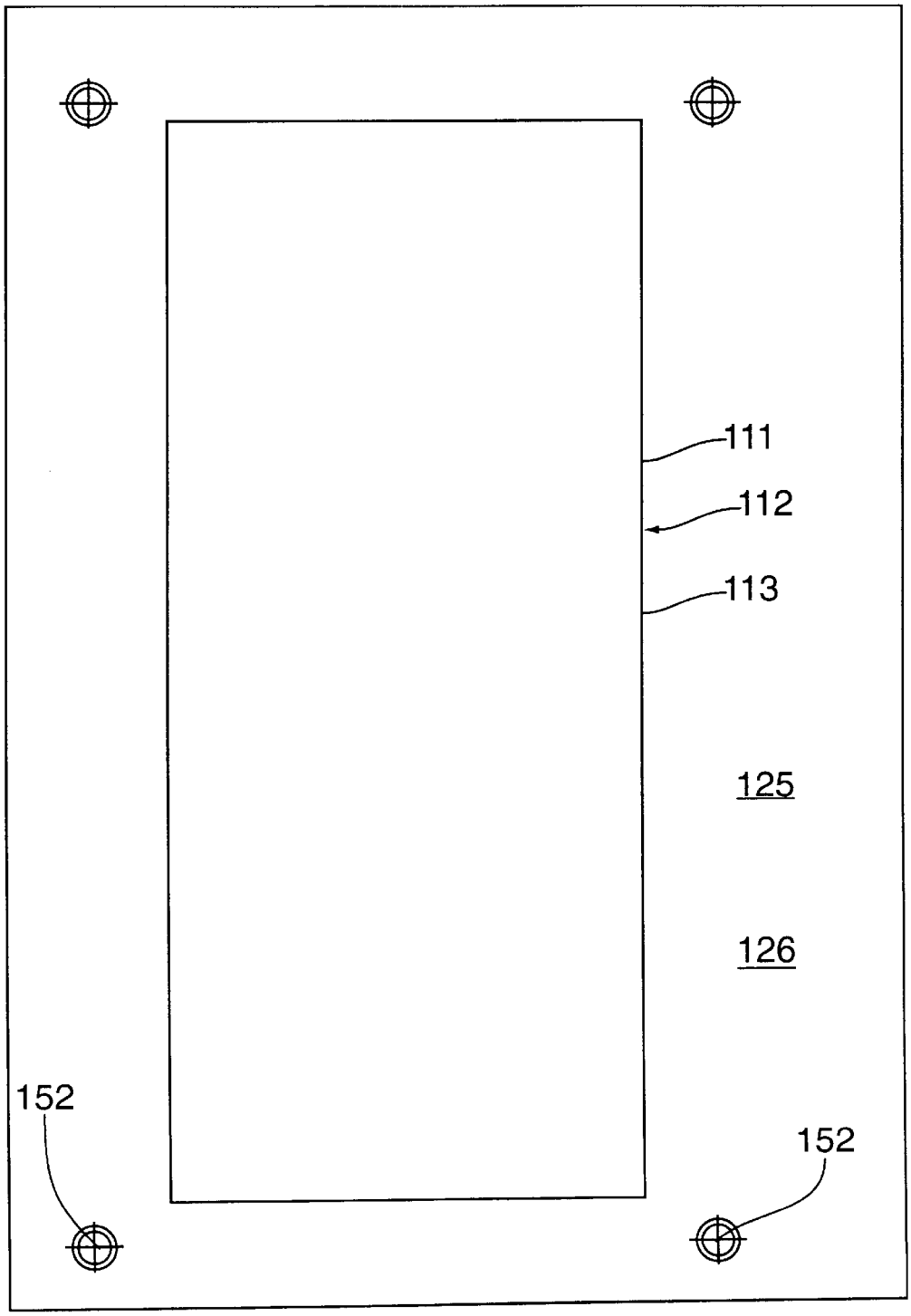
FIG. 4*b* ground electrodes, printed on a sheet of dielectric film, of the transducer of the embodiment in FIGS. 3*a* and 3*b,*
Figure 6A:
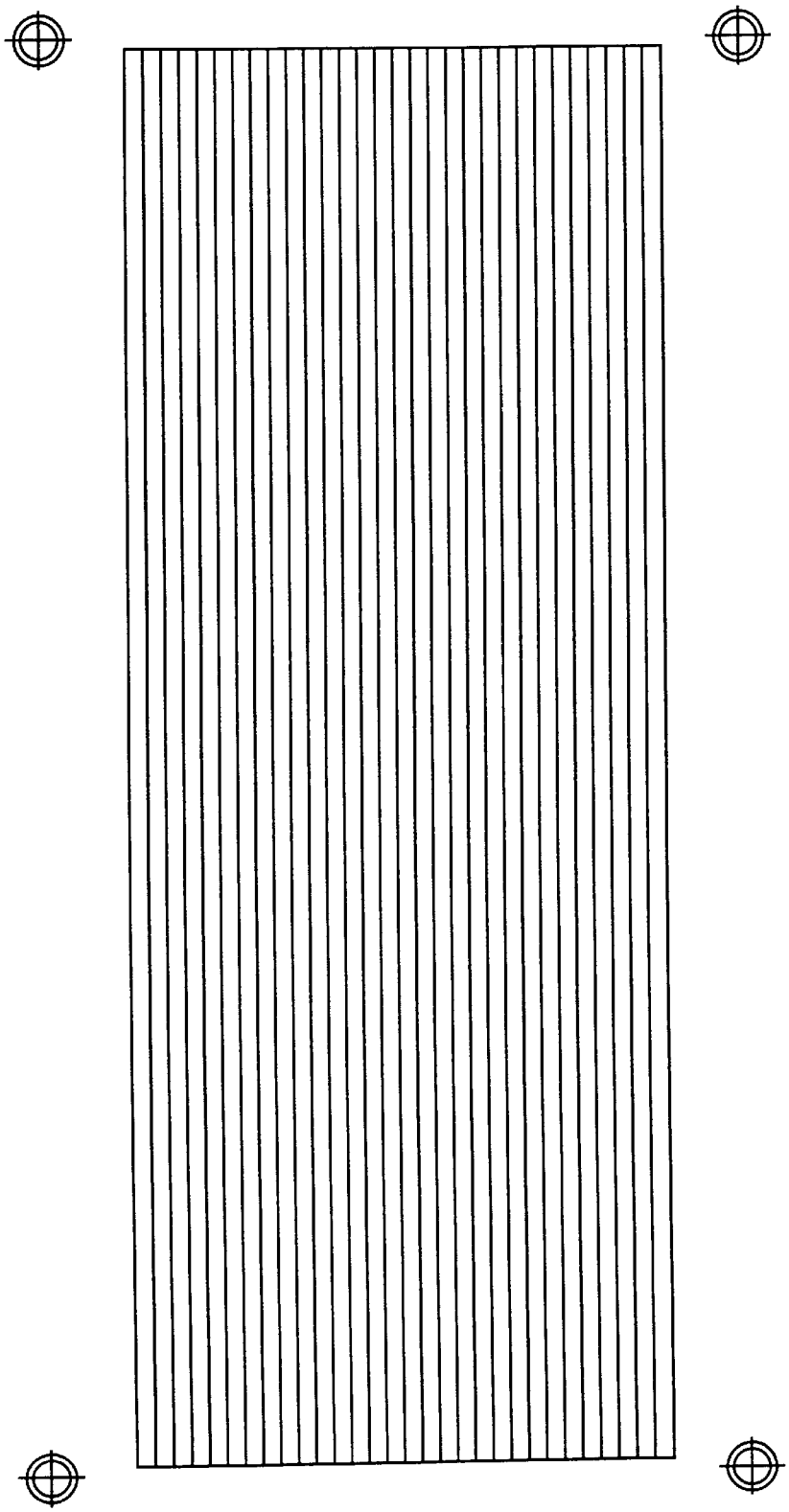
FIGS. 6*a*–6*b* present top view of the cutter blades of a punching unit of the transducer of the embodiment illustrated in FIGS. 3*a*, 3*b*, 5*c*, 5*d,*
Figure 6B:
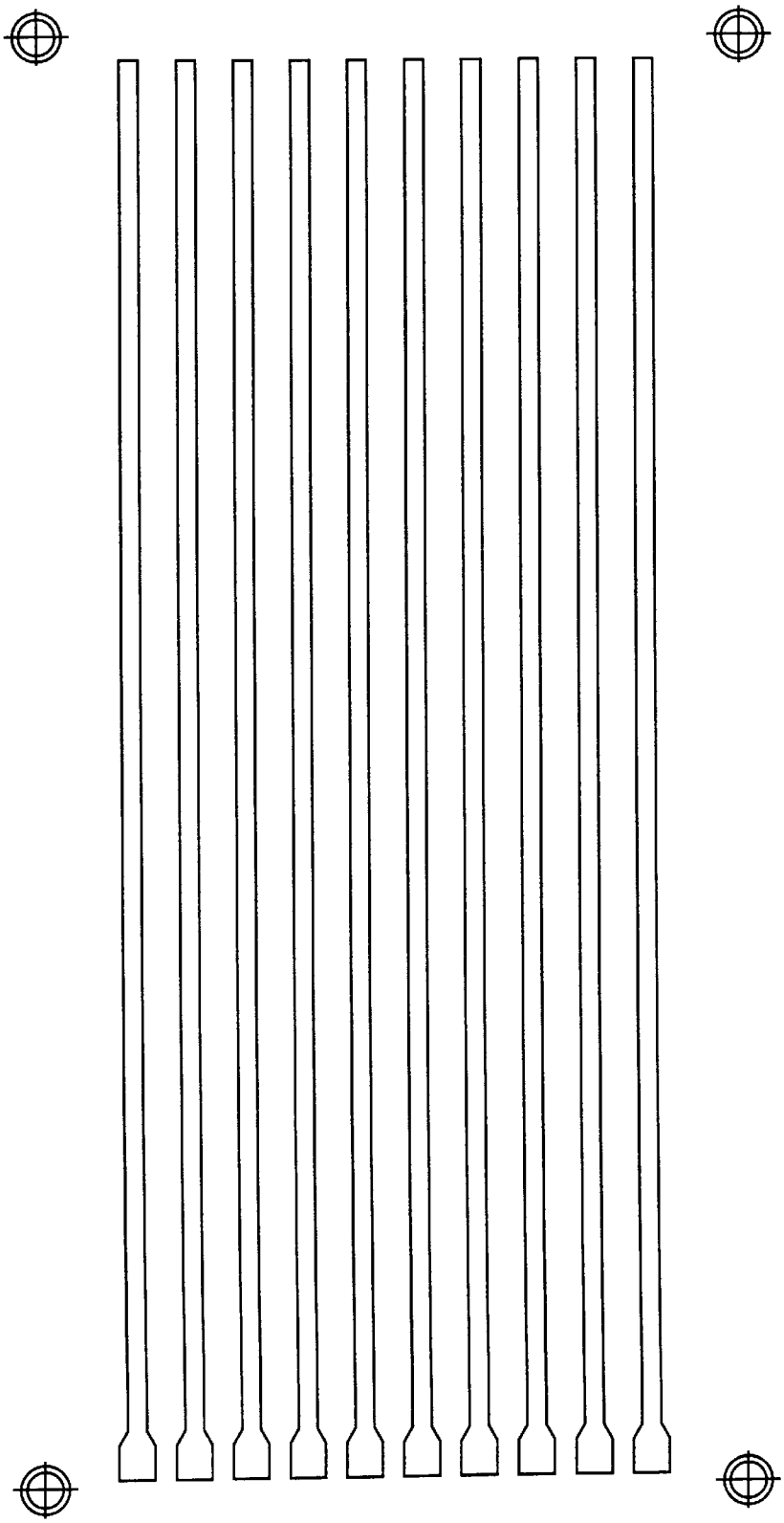

Referring now to FIGS. 3*a*, 3*c*, 4*a*, 4*b*, The transducers of the two embodiments of the invention as shown FIGS. 3*a*, 3*c* are fabricated by first applying suitable glue on the dielectric film 125 on the side where the signal and ground electrodes are screen-printed with silver or graphite paste as shown in FIG. 4*a*. To the other side of this film 125, there is ground electrodes screen-printed as shown in FIG. 4*b*. After this, dielectric sheet cut to suitable size is glued into the area 117. An element 118 size large enough, consisting a laminate of dielectric cellular electret films, preferably swelled, is glued on area 116 and sheet 122 on areas 114, 115. Then glue is applied in the sheet 126 as shown FIG. 4*b*, where there is same ground electrode pattern screen-printed on the both sides of this sheet. The side with glue applied is then glued opposite to the above mentioned laminate, with the register marks 152 in corners in alignment. In this way, a laminate is obtained, from which the transducers can be punched off with a tool as shown in FIG. 6*a*. The transducers can also be cut out from the sheet using e.g. a laser or water jet or some other technique suited for the purpose. This procedure allows a considerably larger number of thin, flexible stringed musical instrument transducers of desired length and width and having a continuous structure without joints than by conventional methods, to be fabricated by the same amount of work while the manufacturing costs remain low.

Figure 8A:
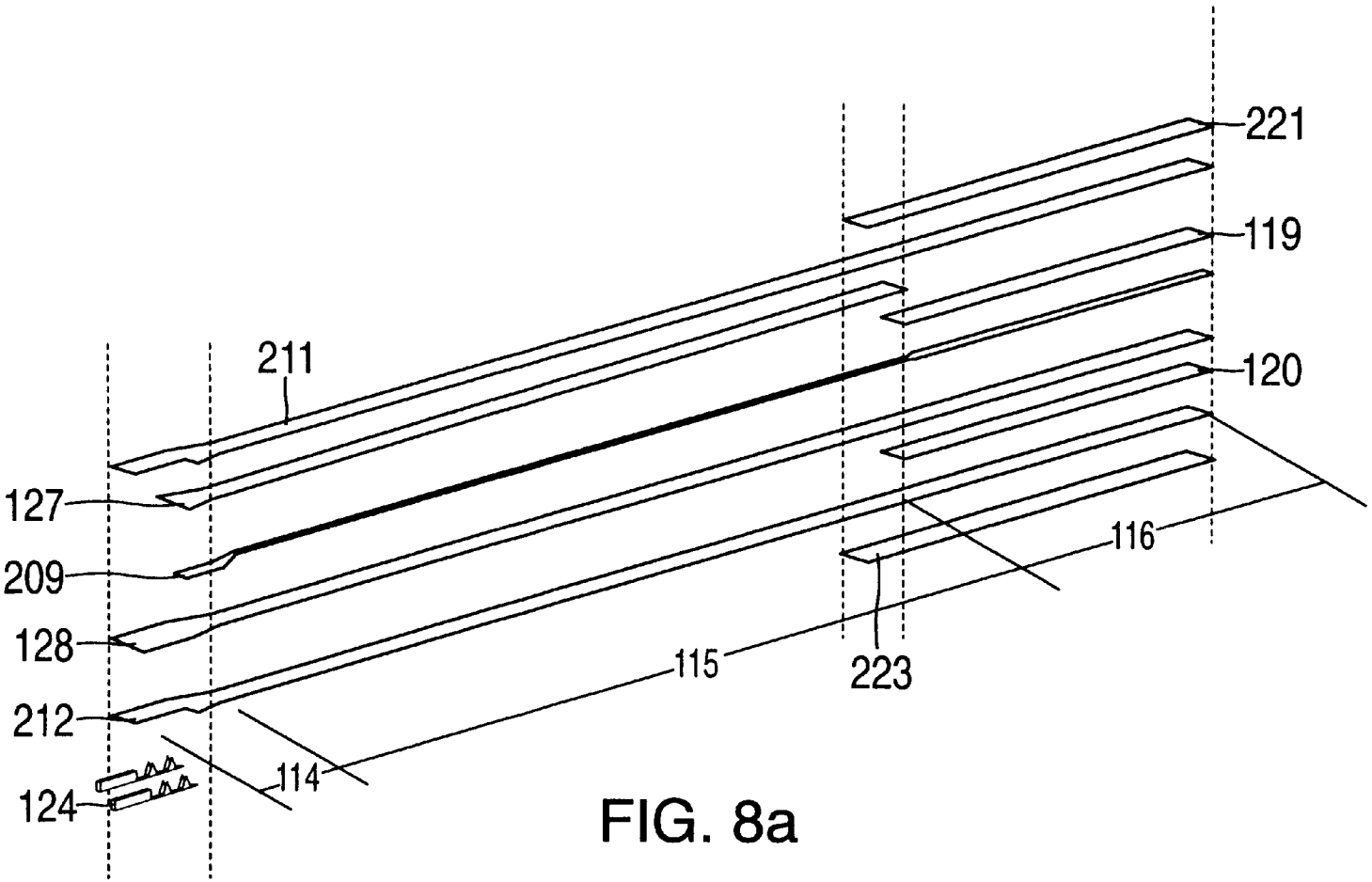
FIG. 8*a* presents an exploded perspective view illustrating the different components that comprise the transducer of the invention without extra dielectric layers carrying the electrodes at the transducer area adjacent to saddle, with connectors in preamplifier end arranged side by side.
Figure 8B:
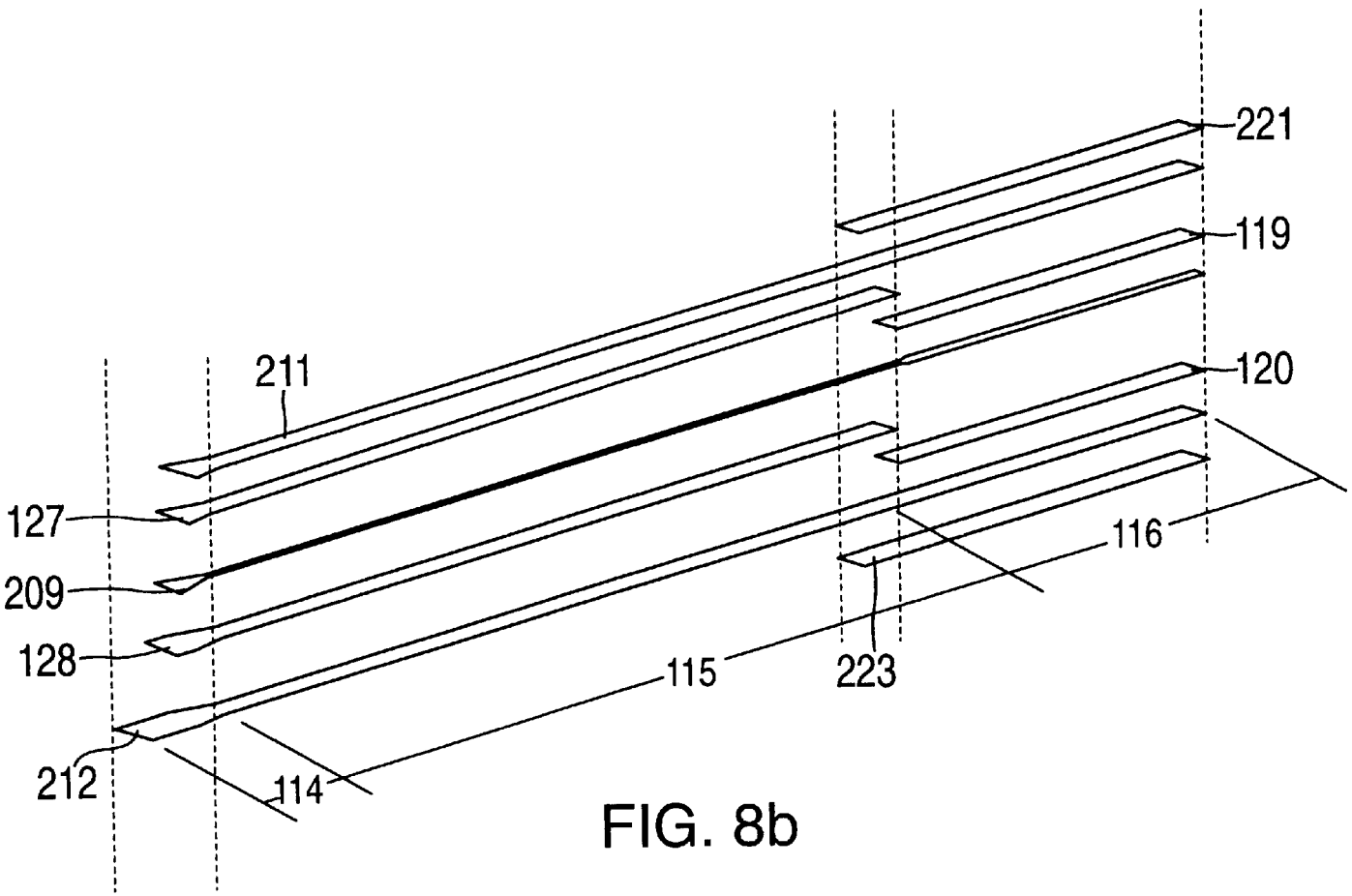
FIG. 8*b* presents an exploded perspective view illustrating the different components that comprise the transducer of the invention without extra dielectric layers carrying the electrodes at the transducer area adjacent to saddle, with sequentially arranged connecting areas in preamplifier end.

The transducers of invention in FIGS. 8*a* and 8*b* consists of a connector part 114 including connectors connecting the transducer to a preamplifier, a connection part 115 corresponding to a connection cable in a conventional transducer and a transducer part 116 for converting the string vibrations into electric signals. As may be noted the transducers in FIGS. 8*a* and 8*b* have no separate transducer part and no separate conductor for connecting it to a signal processing device, but are of a unitary, flexible and laminated structure extending from the end of transducer part 116 unitary as a connection part 115 up to the connector part 114 and in which the connections for connecting it to a preamplifier can be disposed in sequentially or side by side.

Referring now to FIG. 8*a*, signal electrode 209 is a thin metal film, for example tin-bronze-alloy or tinned copper or aluminium with thickness of preferably 0,035 mm. It is to be noted that many thin metal films and thickness are suitable for the application. On both sides of the signal electrode 209 there are swelled dielectric cellular electret films 119, 120, and on the outer sides of the cellular electret films 119, 120, ground electrodes 211, 212. Signal electrode 209 has a form where the electrode is broad in the transducer part and narrow in the connection part. In the connector part the signal electrode has an area corresponding the connection area of the connector 124. Ground electrodes 211, 212 each comprises of thin metal film. Both the ground electrodes 211, 212 are connected together with a connector 124 in the connector part 114.

Cellular electret films 119, 120 in the transducer area may each comprise of several film layers. Each film 119, 120 is charged. Preferably positive charges are injected onto the underside of sheet 119 and onto the top side of sheet 120. Negative charges may be injected onto the top side of sheet 119 and onto the underside of sheet 120 but it is not essential. The films 127, 128 in the connection part are preferably uncharged operating thus as isolating film layers between the electrodes. It is also possible to extend the cellular electret films 119, 120 all the way to the connector part 114 but preferably use only partially charged film so that there is no charges in the connection part 115, to avoid the connection part become microphonic picking sounds from inside the instrument and handling noises. The ground electrodes 211, 212 can also be sputtered, evaporated, chemically metallized or screenprinted to the outer sides of the bubble films 119, 120. It is also possible to arrange the signal electrode 209 directly on the face of bubble film 119 or 120 by for example chemical metallizing process or simply by screen-printing with silver paste. It is possible to use hybrid structure, with ground electrodes arranged on the surfaces of for example polyester film and signal electrode on the surface of the electret films 119, 120. In this embodiment, to increase the output voltage and improve the string-to-string balance, it is also possible to use two, or even more, signal electrodes 209 by using three or more transducer elements 119–120 and in between each said element having one signal electrode 209 and at the outermost faces of the outermost transducer elements having the ground electrodes 211–212. Further, by using two signal electrodes, two ground electrodes and three transducer elements, and having the two signal electrodes in connection part arranged side-by-side, an differential transducer can be obtained. It is also possible to arrange the signal electrode in the tranducer area to be for example round shape, or oval, or square, or multiple round areas in line, depending on the preferred embodiment. Multiple round areas in line, with small weigh over each round area, is very good design for contact pickup installed in the bridge plate inside the guitar, right under the saddle, working as an accelerometer.

The outermost film layers 221, 223, are uncharged cellular film layers, preferably less than 100 microns in thickness, which due their elastic structure even out the possible roughness and unevenness at the instruments saddle slot and saddle and therefore improve the string-to-string balance but do not change the instruments original acoustic sound. However, these film layers 221, 223 are not essential for the transducers operation. Rubber layers have been used to improve string-to-string balance, but using them effects more in instruments original acoustic sound and playing "touch".

Figure 11:
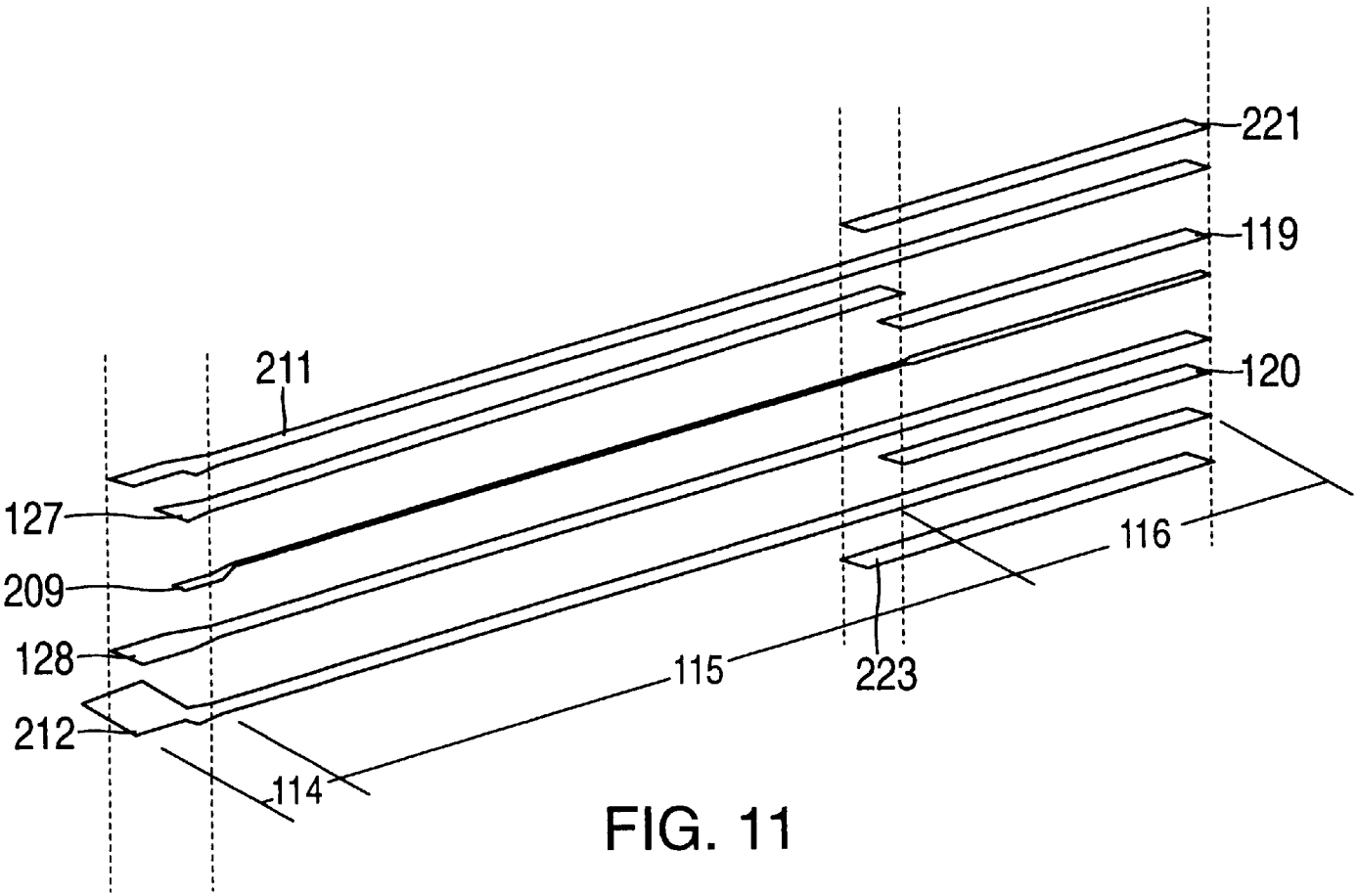
FIG. 11 presents an exploded perspective view illustrating the possible screening of the connector end.

The FIG. 11 shows how the ground electrode 211 may have an extension 224 on the side to form shielding against electrical interference in the connector end 114. Because the connector area in the signal electrode is open for electromagnetic interference, it must be shielded. Typically this is taken care by metal housing of the preamplifier circuitry, but by this way, an very small preamplifier circuitry can be integrated into the connector end. The components of the circuitry, preferably one field-effect FET) transistor and one resistor, are connected to the transducers electrodes 209, 211, 212 and the screening extension 224 is folded around the connector end 114 by using double sided tape 226, which also forms the necessary insulating in between the components and extension 224. Leads are connected to the circuitry for taking the signals to the amplifier and sound system. By having the preamplifier circuitry as close as possible to the transducer unit, the capacitance of the connection part is lowest possible and the signal-to-noise ratio becomes significantly better.

To make an contact pickup according to invention, simply the transducer area is arranged to be for example round 15 mm diameter disk-like, or multiple round areas in line, for example 5, and an separate weigh, for example 0,5 mm thick copper plate of same shape is glued over the round transducer area, on the opposite side of the side which attaches to instrument. The weigh works as mass against which the instrument vibrates and which further causes signal output proportional to sound-source. The transducer end with weigh can further be encapsulated to prevent the transducer to pickup up air-movements which can cause unclear sound, but only vibrations from the surface it is attached to. With this type use, we have noticed that the signal output increases proportional to frequency due the acceleration effect. Therefore a low-pass filter is needed at the preamplifier part, preferably between 100 Hz and 1000 Hz, whether fixed or with adjustable control. In a double bass, for example, interesting features can be obtained, by dividing the contact transducers signal into two channels in the preamplifier, and having in one channel the low-pass filter at high frequency, for example at 5 KHz, and having the low-pass filter at other channel for example at 200 Hz, a and having a switch to change the sound between each channel.

Figure 9:
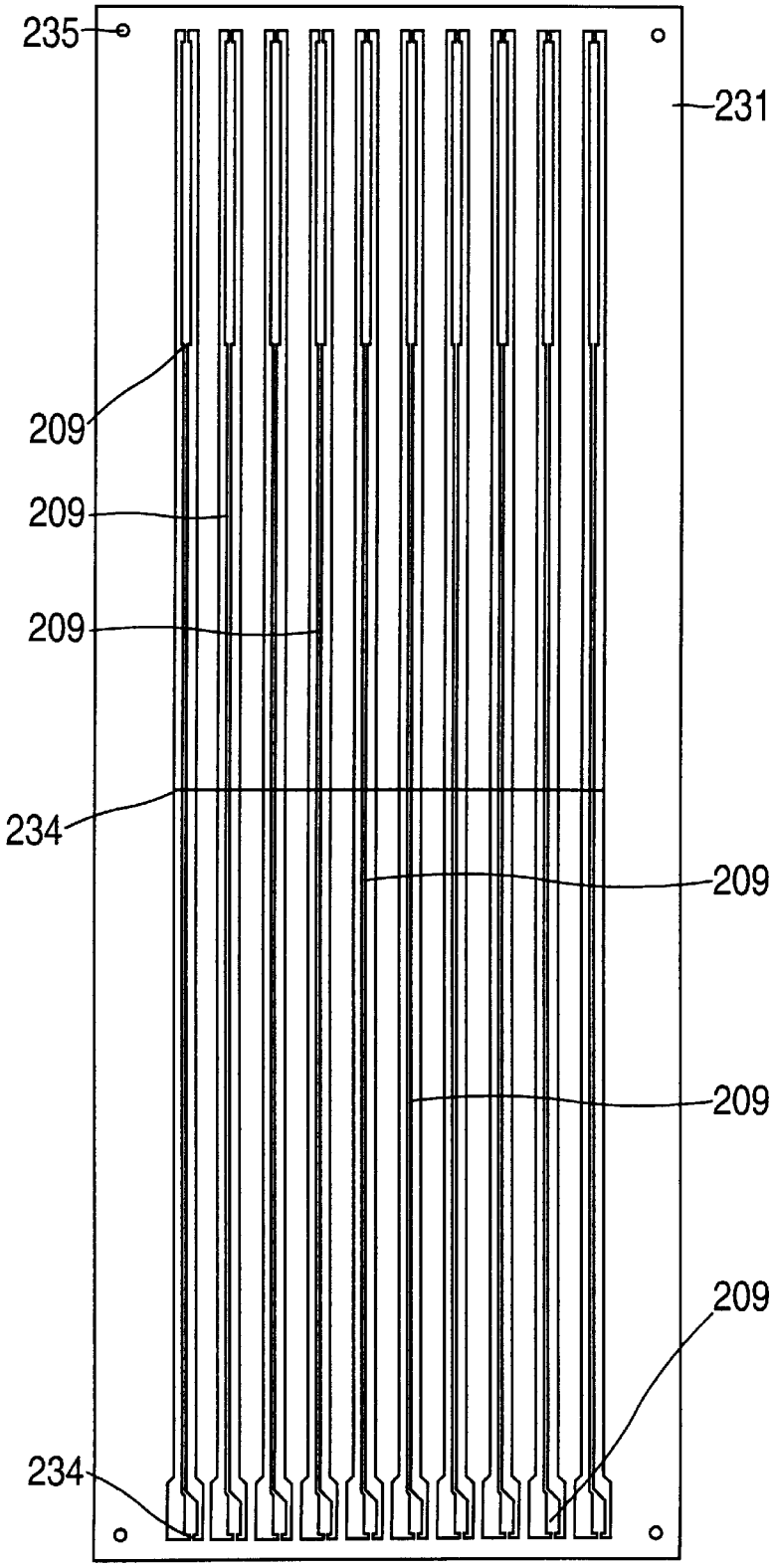
FIG. 9 presents the signal electrodes of the transducer of the embodiment in FIG. 8*a,*
Figure 10:
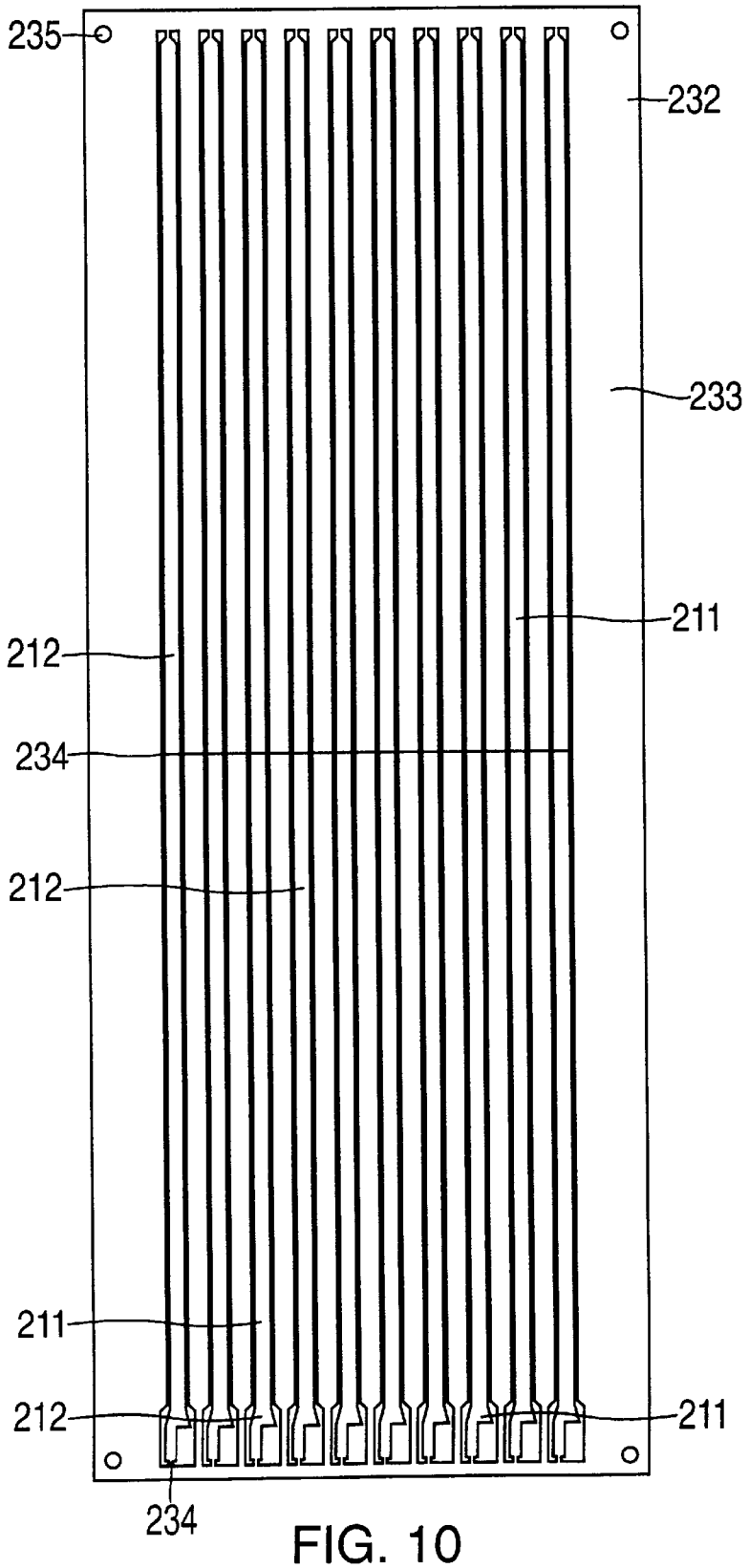
FIG. 10 presents one side ground electrodes of the transducer of the embodiment in FIG. 8*a,*

The transducers in FIGS. 8*a* and 8*b* and 11 are fabricated as follows:

Referring to FIG. 9 signal electrodes 209 and ground electrodes 211, 212 are made of a thin metal film 231, 232, 233. Firstly the thin metal film 231, 232, 233 is coated both sides with an insulating material in the areas to form the electrodes. Secondly the metal films 231, 232, 233 are taken into chemical corrode process where all metal except the areas coated with insulating material, is corroded away. Thirdly, the metal film is taken into next chemical process, where the insulating material is removed. After this, a metal film 231, 232, 233, where the wanted electrodes are connected to each others and frame surrounding them with very narrow keepers 234, is remained. In the corners of each metal film 231, 232, 233 there is a hole 235 to ease the assembly. It is to be noted that there is other ways too to make similar metal film 231, 232, 233. One way is to laser cut the same pattern to the metal film, other way is die-cutting the metal film with suitable tool having the same pattern. Water cutting can also be used. By using laser or water cutting, several films can be manufactured simultaneously.

Cellular electret film elements 119, 120 size large enough, consisting typically a laminate of 1–3 dielectric cellular electret films, preferably swelled, and metal films 231, 232, 233 are glued together so that first against metal film 232 with ground electrodes, transducer element 119 and insulating layer 127 are glued, and next, on the other side of the transducer element 119 and insulating layer 127, the metal film 231 with signal electrodes is glued, and next, to the other side of metal film 231, second transducer element 120 and second insulating layer 128 are glued, and next, on the other sides of the transducer element 120 and insulating substrate 128, metal film 233 with second ground layers is glued. In this way a laminate is obtained from which the transducers can be cut away by for example by die-cutting, laser cutting or water cutting. Further the connectors 124 are connected by pressing them to connector end 114.

This procedure allows a considerably larger number of thin, flexible stringed musical instrument transducers of desired length and width and having a continuous structure without joints than by conventional methods to be fabricated by the same amount of work while the manufacturing costs remain low. Further, referred to the FIGS. 8*a* and 8*b*, the transducers can be manufactured very thin without any extra flexible firm insulating substrates to carry the electrodes. Because there is thickness saved due no extra firm insulating substrates, there can be more of active layers, easily 4 layers, which further improves the output voltage and thus also the signal-to-noise ratio.

It is also possible to arrange the electrodes 209, 211, 212 directly onto the cellular electret films 119, 120 by using for example screen-printing, evaporating, sputtering or chemical metallising. Further, cellular film strips 221, 223 may be arranged to the outer faces or ground electrodes 211, 212, to even out the possible roughness of saddle and saddle slot and thus improve the string-to-string balance.

It is obvious to the person skilled in the art that different embodiments of the invention are not restricted to the examples described above, but that they can be varied within the scope of the claims presented below. The number of films and layers on top of each other can be chosen in accordance with the need in each case; there can be multiple transducer areas and area can also have a shape other than rectangular in top view. The transducer can also be used not only with most string instruments, like guitar, violin, bass, mandolin and so on, but also for example with wind instruments.

I claim:

1. Transducer for converting mechanical stress into electric signals, said transducer comprising:

a transducer part and a connection part;

at least one transducer element with a first and a second side;

at least one dielectric layer at least on the first side of the transducer element;

at least one signal electrode, said signal electrode being arranged in between the transducer element and the dielectric layer;

at least one ground electrode being arranged on the second side of the transducer element;

wherein the transducer element is a dielectric electret film containing a permanent electric charge;

wherein the transducer part has a unitary laminated structure; and wherein the signal electrode is on the first side of the dielectric layer, between the dielectric layer and the transducer element, and the ground electrode is on the second side of the dielectric layer, and wherein said electrodes continue unitary from the transducer part as a connection part for connecting the transducer to a signal processing device.

2. Transducer as defined in claim 1, wherein the dielectric electret film is a biaxially oriented foamed film layer comprising essentially flat gas bubbles or voids or cells.

3. Transducer as defined in claim 2, wherein the dielectric electret film is swelled.

4. Transducer as defined in claim 1, wherein the electrodes at the connector end for connecting the transducer to a signal processing device are disposed side by side.

5. Transducer as defined in claim 1, wherein at least one signal electrode for connecting the transducer to a signal processing device is arranged at one end of the transducer.

6. Transducer as defined in claim 1, wherein at least two ground electrodes are electrically connected together at one end of said transducer.

7. Transducer as defined in claim 1, wherein several signal electrodes are arranged on the surface of one or more thin and flexible dielectric materials in such manner that in each one of the signal electrodes a separate charge signal is generated when the string in conjunction to the electrode vibrates, and which electrodes together with the ground electrodes of the transducer constitute all the electrically conductive surfaces required in the transducer to connect the transducer to a signal processing device.

8. Transducer as defined in claim 1, wherein signal and ground electrodes of the transducer are disposed side by side at the connector end to connect them to a signal processing device.

9. Transducer as defined in claim 1, wherein the transducer element is arranged between dielectric layers and the signal electrode is disposed on a dielectric layer facing the transducer element.

10. Transducer as defined in claim 1, wherein the signal electrode is essentially inside the transducer structure in order to reduce the electromagnetic interference.

11. Transducer as defined in claim 1, said transducer constructed of a flexible layered sheet structure.

12. Transducer as defined in claim 1, wherein at least one weigh is attached on one side of the said transducer.

13. Transducer as defined in claim 12, wherein the transducer part with weigh is encapsulated.

14. Transducer for converting vibrations into electric signals, said transducer comprising:

at least one transducer element;

at least one dielectric film on at least one side of the transducer element;

at least one signal electrode;

at least one ground electrode;

a transducer part and a connection part;

wherein the signal electrode layer is arranged in between the dielectric film and transducer element, and the transducer element contains at least one permanently charged dielectric electret film.

15. Transducer as defined in claim 14, wherein the dielectric electret film is a biaxially oriented foamed film layer comprising essentially flat gas bubbles or voids or cells.

16. Transducer as defined in claim 15, wherein the dielectric electret film is swelled.

17. Transducer as defined in claim 14, wherein at least one weigh is attached on one side of the said transducer.

18. Transducer as defined in claim 17, wherein the transducer part with weigh is encapsulated.

19. Transducer for converting mechanical stress into electric signals, said transducer comprising:

at least one transducer element;

at least one dielectric layer on at least one side of the transducer element;

at least one signal electrode; and at least one ground electrode, the transducer having a transducer part and a connection part;

wherein the transducer element is comprising at least one charged electret film;

where at least the signal electrode is arranged between the dielectric layer and transducer element; and where the signal electrode is essentially inside the transducer structure in order to reduce the electromagnetic interference.

20. Method for forming a transducer for transforming mechanical stress into electric signals, said transducer comprising:

at least one transducer element;

at least one dielectric film on at least one side of the transducer element;

at least one signal electrode, said signal electrode arranged in between the dielectric film and transducer element;

at least one ground electrode;

a transducer part;

a connection part;

wherein the transducer element is comprised of at least one electret film containing a permanent electric charge;

forming said electrodes on one or more dielectric films or on transducer element material side by side; and gluing the dielectric films and the transducer element material against each other so that the charged electromechanical transducer film is placed in a desired area, said electrodes forming one or more electrically conductive surfaces required at each transducer.

21. Method for forming a transducer according to claim 20, wherein the electrically conductive surfaces formed by the electrodes are arranged sequentially at one end of the transducer for connecting to a signal processing device.

22. Method for forming a transducer according to claim 20, wherein the electrically conductive surfaces formed by the electrodes are arranged side by side at one end of the transducer for connecting to a signal processing device.

23. Method for forming a transducer according to claim 20;

wherein a suitable fastening substance is applied in between the first dielectric film and the first side of the electromechanical transducer material, consisting at least one charged electret film, fastening the first dielectric film and first side of the transducer material together so that the signal electrodes are arranged in between; and fastening, with suitable substance, a second dielectric sheet and the laminate obtained above, the second side of the transducer element against the dielectric sheet, together, with ground electrodes arranged in between the transducer material and dielectric sheet.

24. Method for forming a transducer according to claim 23, wherein a laminate is obtained, from which the transducers are cut out.

25. Method for forming a transducer according to claim 20, wherein the electromechanical film is a dielectric electret film, said dielectric film being a biaxially oriented foamed film layer comprising essentially flat gas bubbles or voids or cells, wherein a permanent electric charge has been injected into the film material.

26. Method for forming a transducer as defined in claim 25, wherein the electret film is swelled.

27. Transducer for converting mechanical stress into electric signals, said transducer comprising:

at least two transducer elements, said elements having first and second surfaces;

at least one signal electrode layer arranged between two transducer elements, said signal electrode layer being a conductive layer arranged in between the first surfaces of the two transducer film elements; and at least two ground electrode layers, said ground electrode layers being conductive layers arranged against the second sides of the transducer film elements;

and said electrodes extend from the transducer part as connection part for connecting the transducer to a signal processing device; and wherein transducer elements are permanently charged dielectric electret films.

28. Transducer according to claim 27, wherein dielectric porous electret films are biaxially oriented foamed film layers.

29. Transducer as defined in claim 28, wherein the dielectric porous electret film is swelled.

30. Method for forming a transducer according to claim 27, wherein a weigh is attached on the other side of the said transducer.

31. Method for forming a transducer according to claim 30, wherein the transducer part with weigh is encapsulated.

32. Method for forming a transducer comprising following steps:

arranging at least one signal electrode layer against first surface of a transducer film element;

arranging at least one signal electrode layer between first surfaces of two transducer elements, the signal electrode layer being a conductive layer; and arranging ground electrode layers against second surfaces of said transducer film elements;

wherein transducer part has a unitary laminated structure; and wherein the transducer elements are permanently charged electret films.

33. Method for forming a transducer according to claim 32, wherein electret films are biaxially oriented foamed film layers comprising essentially flat gas bubbles or voids or cells.

34. Method for forming a transducer according to claim 33, wherein biaxially oriented foamed film layers, comprising essentially flat gas bubbles or voids or cells, are swelled.

35. Method for forming a transducer according to claim 32, wherein one ground electrode has extension part overlapped over the connector part for forming a shield.

36. Method for forming a transducer according to claim 35, wherein the overlapped extension forms the shield for electronic preamplifier circuitry.

37. Method for forming a transducer according to claim 32, wherein a weigh is attached on the other side of the said transducer.

38. Method for forming a transducer according to claim 37, wherein the transducer part with weigh is encapsulated.

* * * * *